US005221949A

United States Patent [19]

Miyamoto

[11] Patent Number: 5,221,949

[45] Date of Patent: Jun. 22, 1993

[54] FEEDING TIMING CONTROL FOR AN IMAGE FORMING APPARATUS

[75] Inventor: Hirohisa Miyamoto, Kobe, Japan

[73] Assignee: Minolta Camera Co., Ltd., Osaka, Japan

[21] Appl. No.: 686,778

[22] Filed: Apr. 17, 1991

[30] Foreign Application Priority Data

Apr. 20, 1990 [JP] Japan ..... 2-105661
Apr. 20, 1990 [JP] Japan ..... 2-105662

[51] Int. Cl.[5] ..... G03G 21/00; B65H 5/12

[52] U.S. Cl. ..... 355/309; 271/9; 271/111; 271/259; 271/266

[58] Field of Search ..... 355/308, 309, 316, 321; 271/9, 110, 111, 258, 259, 266

[56] References Cited

U.S. PATENT DOCUMENTS 4,337,935 7/1982 Sawada et al. ..... 271/9
4,548,394 10/1985 Koyama et al. ..... 271/9
4,669,853 6/1987 Sosinski et al. ..... 355/309
4,708,456 11/1987 Shibata et al. ..... 355/309
5,043,771 8/1991 Shibata et al. ..... 355/316 X

FOREIGN PATENT DOCUMENTS 1-53961 3/1989 Japan ..... 271/110
2-193839 7/1990 Japan .

*Primary Examiner*—A. T. Grimley
*Assistant Examiner*—Nestor R. Ramirez
*Attorney, Agent, or Firm*—Willian Brinks Olds Hofer Gilson & Lione

[57] ABSTRACT

An image forming apparatus provided with a plurality of paper transport devices and a control device for outputting driving signals to the plurality of paper transport devices at different timings and outputting stop signals to the plurality of paper transport devices at different timings.

In addition, the control device is capable of changing time difference between the timings for outputting the driving signals and between the timings for outputting the stop signals in accordance with the state of the image forming apparatus such as paper feeding conditions.

32 Claims, 20 Drawing Sheets

FEEDING TIMING CONTROL FOR AN IMAGE FORMING APPARATUS

BACKGROUND OF THE INVENTION 1) Field of the Invention

The present invention relates to an image forming apparatus provided with a recording paper transport device having a plurality of independent driving systems. 2) Description of the Related Art Recently, a paper feeding cabinet containing a plurality of paper cassettes independently accommodating recording papers of various sizes tends to be provided in an image forming apparatus, for example, in a copier. By providing such a paper feeding cabinet, the number of times of supplement or exchange of recording papers, which is troublesome, can be reduced, whereby operability of the copier is improved.

In a copier provided with this type of paper feeding cabinet, are employed two driving systems: a driving system comprising an image forming system including a photoconductive drum and various rollers for transporting a recording paper in a main body; and a driving system for feeding the recording paper from the paper cassette to the main body.

In the former, the rollers include a pair of timing rollers for transporting the recording paper to a transfer charger disposed around the photoconductive drum in synchronism with the rotation of the photoconductive drum and a pair of intermediate rollers for transporting the recording paper to the timing rollers. Each of the above two pairs of rollers is driven by a main motor for driving the photoconductive drum through a clutch.

On the other hand, the latter comprises a paper feeding roller for feeding a recording paper from the paper cassette, a pair of separating rollers for separating one recording paper from the others for feeding in case that a plurality of recording papers are fed by the paper feeding roller and a pair of transport rollers for transporting the separated recording paper to the intermediate rollers. The above rollers are driven by a paper feeding cabinet driving motor (referred to as driving motor, hereinafter) provided in the paper feeding cabinet through a gear mechanism.

In the former, the moment of inertia of a portion which is stopped and driven along with the intermediate rollers is relatively small since the rollers are driven and stopped by engaging and disengaging the clutches (turning on and turning off the clutches), while in the latter, the moment of inertia of a portion which is stopped and driven is large since the transport rollers are driven and stopped by turning on and off the driving motor M2.

This difference in the moment of inertia gives rise to the problems which will be described below when the leading and trailing portions of the recording paper are respectively positioned at the above two driving systems, more specifically, when the recording paper is stopped with its leading portion and trailing portion being held respectively by the intermediate rollers and the transport rollers and when the recording paper which has been stopped in the above condition is transported again by driving the transport rollers and intermediate rollers.

FIG. 1*a* is a time chart showing reduction in the circumferential speeds of the transport rollers and the intermediate rollers when stopping. In FIG. 1*a*, the axis of ordinate indicates the speeds and the axis of abscissa indicates time.

As shown in FIG. 1*a*, when the clutch between the intermediate rollers and the main motor and the driving motor are turned off at the same time, the intermediate rollers are stopped earlier than the transport rollers due to the above difference in the moment of inertia. Therefore, the trailing portion of the recording paper is transported by the transport rollers by a distance indicated by oblique lines in the drawing with its leading portion stopped between the intermediate rollers. As a result, the recording paper is curved or is folded in the middle portion thereof, resulting in deterioration of the quality of the recording paper or paper jamming.

FIG. 1*b* is a time chart showing starting points of the rotations of the transport rollers and the intermediate rollers. In FIG. 1*b*, the axis of ordinate indicates the speeds of the above rollers and the axis of abscissa indicates time. As shown in FIG. 1*b*, where the intermediate rollers and the transport rollers which have been stopped, respectively holding the leading portion and trailing portion of the recording paper, are driven by turning on the clutch and the driving motor at the same time, the intermediate rollers start rotating instantly, increasing the rotating speed rapidly, while the transport rollers start rotating after the lapse of a dead time t0. As a result, the leading portion of the recording paper is rapidly drawn forward by the intermediate rollers. This applies great tension to the recording paper, thereby deteriorating the quality of the recording paper. In addition, the recording paper may be skewed.

The latter problem can be relieved by providing a one-way clutch for allowing the transport rollers to rotate faster than the rotating speed of the driving motor in the same direction as a transport direction of the recording paper. However, in this case also, great tension is applied to the recording paper at the instant the intermediate rollers start rotating.

The above problems are caused when the length of the recording paper in the transport direction (referred to as length Y, hereinafter) is greater than a distance X between the timing rollers and the transport rollers (the sum of a distance A between the timing rollers 22 and the intermediate rollers 23 and a distance B between the intermediate rollers 23 and the transport rollers 205 in FIG. 2). This is for the following reason.

The recording paper is stopped when the leading end thereof has reached the timing rollers 22. Therefore, where the length Y is X or more, the leading and trailing portions of the stopped recording paper are respectively held between the intermediate rollers 23 and between the transport rollers 205.

Further, even if the length Y is less than X, there is the following problem in a continuous copying mode. That is, if the clutch and the driving motor are turned off at the same time, a preceding recording paper transported by the intermediate rollers 23 is stopped earlier than the following recording paper transported by the transport rollers 205. As a result, the preceding recording paper may be bumped by the following recording paper, which also causes paper jamming. Therefore, distance between the recording papers should be long enough to avoid such a problem. This prevents paper feeding efficiency from being improved and restricts the speed of the continuous copying.

In addition, where the plurality of paper cassettes contained in the paper feeding cabinet are driven by the same driving motor, driving load of the driving motor and other elements are varied with paper feeding conditions, for example, the number of paper cassettes (referred to as cassette number, hereinafter). Therefore, if a signal for turning off the driving motor is output at a fixed timing regardless of the paper feeding conditions, stopping point of the driving motor, in other words, stopping point of the transport rollers 205 is varied with the above conditions.

More specifically, the more the cassette number is, the greater the driving load is, that is to say, the earlier the driving motor is stopped.

The paper feeding conditions include a size of a recording paper to be fed (the larger the size is, the greater the driving load is), thickness of the recording paper (the greater the thickness is, the greater the driving load is, due to increase in the recording paper weight and in travel resistance of the recording paper between each pair of rollers), transport speed of a recording paper (transport speed: the rotating speed of the motor; the greater the number is, the longer time the motor takes to stop), paper feeding position (position of the paper cassette from which the recording paper is fed; the farther the paper cassette is from the main body, the greater the driving load is, for example, due to increase in the length of a belt for transmitting driving force), inside temperature of the apparatus and fluctuation of the travel resistance of the recording paper accompanying humidity change in the apparatus.

FIG. 3*a* is a time chart showing a relationship between the driving load and the stopping point of the driving motor. In FIG. 3*a*, the axis of ordinate indicates the speed of the driving motor and the axis of abscissa indicates time. FIG. 3*b* is a view showing a relationship between the paper feeding conditions and the driving load of the driving motor.

As shown in FIG. 3*a*, the greater the driving load is, the shorter the time from turn-off to stop of the driving motor is ($t4<t3<t2<t1$).

Accordingly, in order to prevent paper jamming and improve copying operation efficiency, the stopping point of the driving motor should be determined taking the paper feeding conditions into account.

SUMMARY OF THE INVENTION

An object of the present invention, therefore, is to provide an image forming apparatus capable of stopping and restarting transport of a recording paper using a plurality of transport means and without curving the recording paper or applying excessive and rapid tension thereto.

The above object is fulfilled by an image forming apparatus comprising a first transport device for transporting a recording paper; a second transport device provided upstream of the first transport device in a transport direction of the recording paper; a control device for generating a first stop signal and a second stop signal at different timings so that the recording paper is stopped being held by both the first and second transport devices; and a driving device for driving the first and second transport devices and for stopping the first transport device in response to the first stop signal and stopping the second transport device in response to the second stop signal.

The above object is also fulfilled by an image forming apparatus comprising a first transport device for transporting a recording paper; a second transport device provided upstream of the first transport device in a transport direction of the recording paper; a control device for generating a first stop signal and a second stop signal so that the recording paper is stopped being held by both the first and second transport devices and for generating a first driving signal and a second driving signal so that the recording paper which has been stopped being held by both the first and second transport devices is transported again; and a driving device for stopping and driving the first transport device respectively in response to the first stop signal and the first driving signal and for stopping and driving the second transport device respectively in response to the second stop signal and the second driving signal, wherein the control device generates the first driving signal after generating the second driving signal.

According to the above construction, the stop signals and driving signals for the first and second transport devices are generated at different timings. Therefore, the first and second transport devices can stop transporting the recording paper at the same time and restart transporting at specified speeds at the same time. In addition, the recording paper can be transported by the first transport device in the same distance as it is transported by the second transport device from the time when the first and second driving signals are generated until the first and second transport devices start transporting at specified speeds.

Another object of the present invention is to provide an image forming apparatus capable of stopping and restarting transport of a recording paper using a plurality of transport means and without curving the recording paper or applying excessive and rapid tension thereto even if paper feeding conditions such as construction of a paper feeding unit and that of a paper feeding apparatus are varied.

The above object is fulfilled by an image forming system comprising, an image forming unit including an image forming device for forming an image on a recording paper, a first transport device for transporting the recording paper to the image forming device, a control device for generating a first stop signal and a second stop signal at different timings, and a driving device for driving the first transport device and stopping the first transport device in response to the first stop signal; and a plurality of paper feeding units, each paper feeding unit being connectable with the image forming unit and including a second transport device for feeding the recording papers to the first transport device one by one, and a second driving device for driving the second transport device and stopping the second transport device in response to the second stop signal; wherein the control device has a changing device for changing time difference between the timings at which the first and second stop signals are generated.

The above object is also fulfilled by an image forming apparatus connectable with a paper feeding apparatus which accommodates a plurality of recording papers and feeds the plurality of recording papers to the image forming apparatus one by one, the image forming apparatus comprising an image forming device for forming an image on a recording paper fed from the paper feeding apparatus; a first transport device for receiving a recording paper from the second transport device provided in the paper feeding apparatus and for transporting the received recording paper to the image forming device; a control device for generating a first stop signal for stopping the first transport device and a second stop signal for stopping the second transport device at different timings; and a changing device for changing time difference between the timings at which the first and second stop signals are generated.

According to the above construction, the difference between the timings at which the stop signals for stopping the first and second transport devices are generated can be changed in accordance with the paper feeding conditions. Therefore, the first and second transport devices can stop transporting the recording paper at the same time irrespective of the paper feeding conditions. In addition, the distance by which the recording paper is transported by the second transport device from the time when the second stop signal is generated until the second transport device is stopped can be kept constant irrespective of the paper feeding conditions. Therefore, a relationship between the distance by which the recording paper is transported by the first transport device and the distance by which the recording paper is transported by the second transport device can be kept constant.

BRIEF DESCRIPTION OF THE DRAWINGS

These and other objects, advantages and features of the invention will become apparent from the following description thereof taken in conjunction with the accompanying drawings which illustrate a specific embodiments of the invention. In the drawings.

DESCRIPTION OF THE PREFERRED EMBODIMENTS

Embodiment 1

Figure 4:
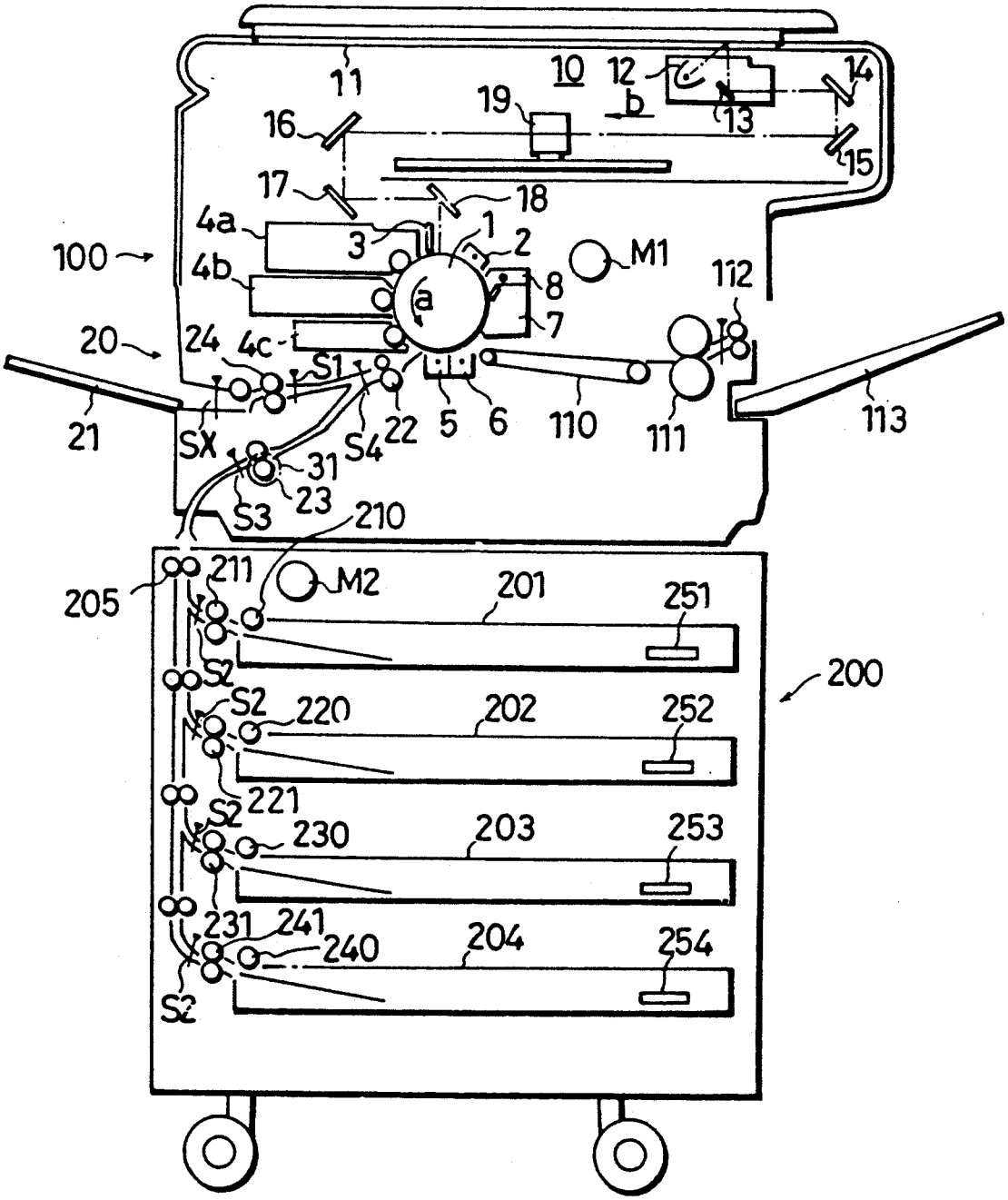
FIG. 4 is a cross sectional view showing an overall construction of a copier according to Embodiments 1 and 2 of the present invention.

An embodiment of the present invention will be described hereinafter, referring to the accompanied drawings. FIG. 4 is a cross sectional view showing an overall construction of a copier according to Embodiments 1 and 2 of the present invention. The copier comprises a main body 100 and a paper feeding cabinet 200, provided below the main body, for feeding a recording paper to the main body 100.

Construction of the Main Body 100

In the central portion of the main body 100, is provided a photoconductive drum 1 which is rotated counterclockwise in a direction of an arrow a by a main motor M1 provided in the main body 100. Around the photoconductive drum 1, in the rotating direction thereof, are provided a charger 2, an eraser 3 for document margins and blank portions, developing devices 4*a*, 4*b* and 4*c*, a transfer charger 5, separating charger 6, a cleaning device 7 and an eraser lamp 8.

When the photoconductive drum 1 has passed under the charger 2, a photoconductive layer thereon is uniformly charged. Then, the photoconductive layer is exposed by a scanning optical system 10, whereby an electrostatic latent image is formed on the surface thereof. Thereafter, a toner is supplied to the developing devices 4*a*, 4*b* and 4*c* to form a toner image. The eraser 3 has a plurality of light emitting diodes arranged along a direction of the image width and is for removing unnecessary charge on the surface of the photoconductive drum 1.

The scanning optical system 10 is provided below a document glass table 11 so that it may scan a document. The scanning optical system 10 comprises an exposure lamp 12, movable mirrors 13, 14, 15, 16 and 16, another mirror 18 and a lens 19. The exposure lamp 12 and the mirror 13 are driven by a scanning motor (not shown) to integrally move in a direction of an arrow b at a speed of v/m (v: circumferential speed of the photoconductive drum 1; fixed irrespective of the copying ratio, m: copying ratio). The mirrors 14 and 15 are also driven by the scanning motor to integrally moved in the direction of the arrow b at a speed of v/2m.

In changing the copying ratio, the lens 19 is moved on the optical axis and the mirrors 16 and 17 are moved and swung, all by a stepping motor (not shown).

A recording paper is fed from a manual paper feeding mechanism 20 or the paper feeding cabinet 200 into the main body 100. The paper feeding cabinet 200 is set on the left bottom portion of the main body 100.

The paper feeding mechanism 20 comprises a pair separating rollers 24 for separating recording papers set on a paper feeding tray 21 one by one, a detection sensor S1, provided downstream of the separating rollers 24, for detecting presence/absence of the recording paper and a sensor SX, provided upstream of the separating rollers 24, for detecting whether or not the recording paper is set. When the sensor SX detects the recording paper, the separating rollers 24 are rotated to separate the recording papers one by one and transport the separated recording paper to a pair of timing rollers 22. Then, when the sensor S1 detects the transported recording paper, a CPU 30 (FIG. 5) outputs a scan start signal to the scanning optical system 10. The microcomputer will be described in detail later.

The recording paper fed into the main body 100 is once stopped by the timing rollers 22 and then, fed to the transfer charger 5 in synchronism with the toner image formed on the photoconductive drum 1. Thus, the toner image is transferred onto the recording paper by the transfer charger 5.

The recording paper having the transferred image thereon is separated from the photoconductive drum 1 by the separating charger 6 and fed to a fixing device 111 by a transport belt 110. The transferred image is fixed by the fixing device 111 and the recording paper is delivered onto a delivery tray 113 by a pair of delivering rollers 112.

On the other hand, after transference, a residual toner and residual charge on the photoconductive drum 1 are respectively removed by the cleaning device 7 and the eraser lamp 8 for the next copying cycle. (Construction of the paper feeding cabinet 200)

In the paper feeding cabinet 200, are vertically arranged four paper cassettes 201, 202, 203 and 204 respectively accommodating recording papers of different sizes. The paper cassettes 201, 202, 203 and 204 respectively have paper size detecting sensors 251, 252, 253 and 254 for detecting the size of the recording paper and automatic paper feeding mechanisms which are driven by a paper feeding cabinet driving motor M2 ( referred to as driving motor M2, hereinafter). Since the paper cassettes 201, 202, 203 and 204 have the same construction, the paper cassette 201 will be explained below as a representative example and explanation of the other cassettes 202, 203 and 204 is eliminated.

The driving motor M2 is actuated when a print key (not shown) is turned on. The main motor M1 is also actuated by turn-on of the print key, whereby driving of the image forming system including the photoconductive drum 1 is started.

A recording paper accommodated in the paper cassette 201 is transported to a pair of intermediate rollers 23 by the driving motor M2. The intermediate rollers 23 are provided in a lower portion of the main body 100 on the left of the timing rollers 22 in the drawing.

The recording paper is transported through a paper feeding roller 210 for feeding a recording paper accommodated in the paper cassette 201, a pair of separating rollers 211 for separating one recording paper from the others for feeding in case that a plurality of recording papers are fed by the paper feeding roller 210 and a pair of transport rollers 205 provided in a left upper corner portion of the paper feeding cabinet 200.

The paper feeding rollers 210 and separating rollers 211 are driven through clutches (not shown) which are engaged while the driving motor M2 is driven. The transport rollers 205 are driven by the driving motor M2 through a gear mechanism or a belt pulley mechanism.

When the recording paper is separated by the separating rollers 211, the paper feeding sensor S2 provided at the exit side of the separating rollers 211 is turned on. Then, the recording paper is fed to the transport rollers 205 and transported to the intermediate rollers 23. Before the recording paper reaches the intermediate rollers 23, a sensor S3 provided before the intermediate rollers is turned on. Then, the recording paper is transported to the intermediate rollers and to the timing rollers 22. Upstream of the timing rollers 22 in the transport direction of the recording paper, a sensor S4 for detecting the leading end of the recording paper is provided.

When the sensor S3 is turned on, the CPU 30 receives a detection signal from the sensor S3 and outputs a scan start signal to the scanning optical system 10 after a predetermined time has passed since the turn-on of the sensor S3 to start an image forming operation.

When the sensor S4 detects the recording paper, the CPU 30 turns off an intermediate clutch 31 for connecting the main motor M1 and the intermediate rollers 23, whereby the intermediate rollers 23 are stopped. The CPU 30 also turns off the driving motor M2, whereby the transport rollers 205 are stopped.

Concerning the paper cassettes 202, 203 and 204, like numerals are used for like members. Paper cassettes 202, 203 and 204 include paper feeding rollers 220, 230 and 240, respectively; and the reference numeral S2 is common to paper feeding sensors for separating rollers 211, 221, 231 and 241. (Motor driving circuit)

A motor driving circuit for driving the main motor M1 and the driving motor M2 will be described with reference to the driving motor M2 and FIG. 5.

The CPU 30 controls the image forming operation and driving of the driving motor M2. The driving motor M2 is a 3-phase DC motor and is driven by the CPU 30 as follows through a drive IC 33 connecting the CPU 30 and the driving motor M2.

Figure 5:
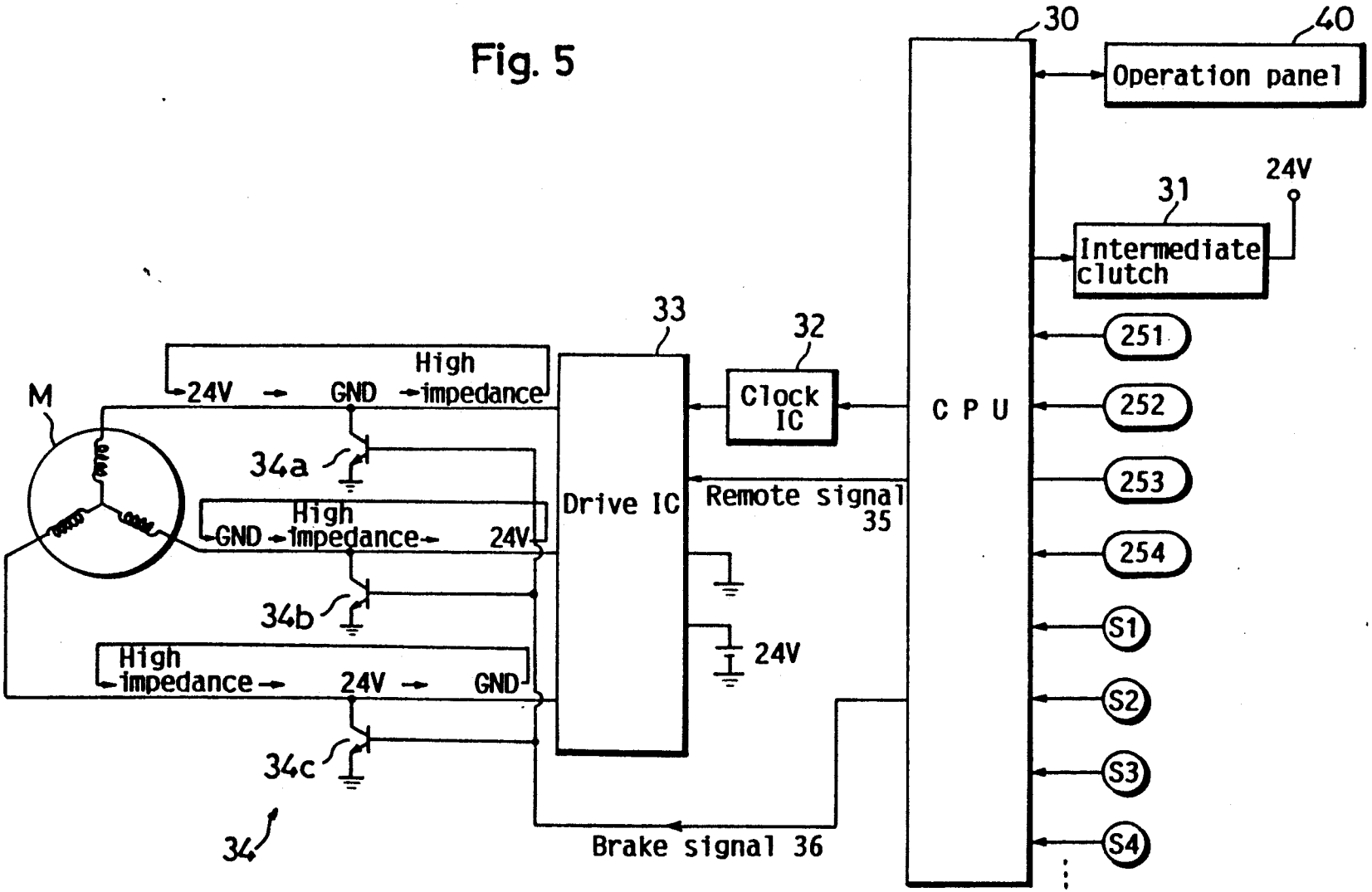
FIG. 5 is a circuit diagram showing a motor driving circuit of the same.

That is, while a remote signal (driving start signal) 35 is output from the CPU 30 to the drive IC 33, each of terminals of the drive IC 33 connected to the three phases of the driving motor M2 is switched to 24 V, grounding and high-impedance in sequence as shown in FIG. 5 by switching a transistor in the drive IC 33.

The rotating speed of the driving motor M2 is controlled by controlling the timing of the above switching. More specifically, a clock IC 32 generates a clock signal of a predetermined frequency in response to a command signal from the CPU 30 and the drive IC 33 switches the terminals at a timing corresponding to the clock signal.

On the other hand, a brake signal 36 is output from the CPU 30 in order to stop the driving motor M2 quickly. When the brake signal 36 is supplied to switching transistors 34*a*, 34*b* and 34*c* of a brake circuit 34, the three phases of the driving motor M2 are grounded, whereby the driving motor M2 is stopped.

In order not to damage the switching transistors 34*a*, 34*b* and 34*c*, the CPU 30 does not output the remote signal 35 and the brake signal 36 at the same time.

Further, to the CPU 30, are connected the detection sensor S1, the paper feeding sensors S2, the sensor S3, the sensor S4 and paper size detecting sensors 251, 252, 253 and 254. Driving of the driving motor M2 is controlled in accordance with the detection results of the above sensors.

The intermediate clutch 31 and an operation panel 40 for key input are also connected to the CPU 30. Overall control of the CPU 30

Figure 6:
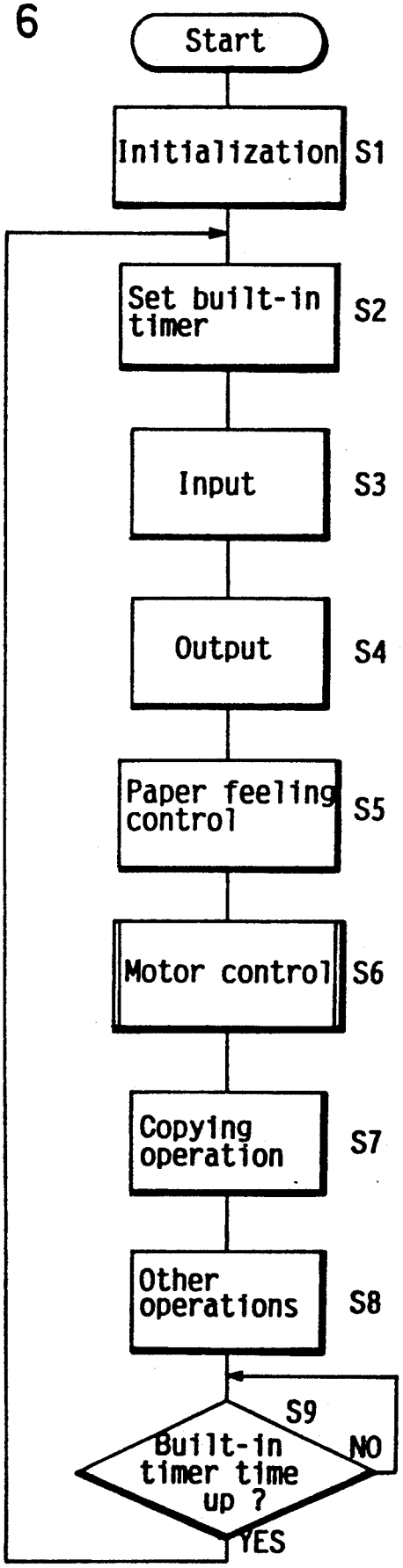
FIG. 6 is a flowchart of a main routine of the same, FIG. 7(*a–d*) are a flowchart of a motor control subroutine for controlling a driving motor M2, etc. in Embodiment 1.
Figure 7A:
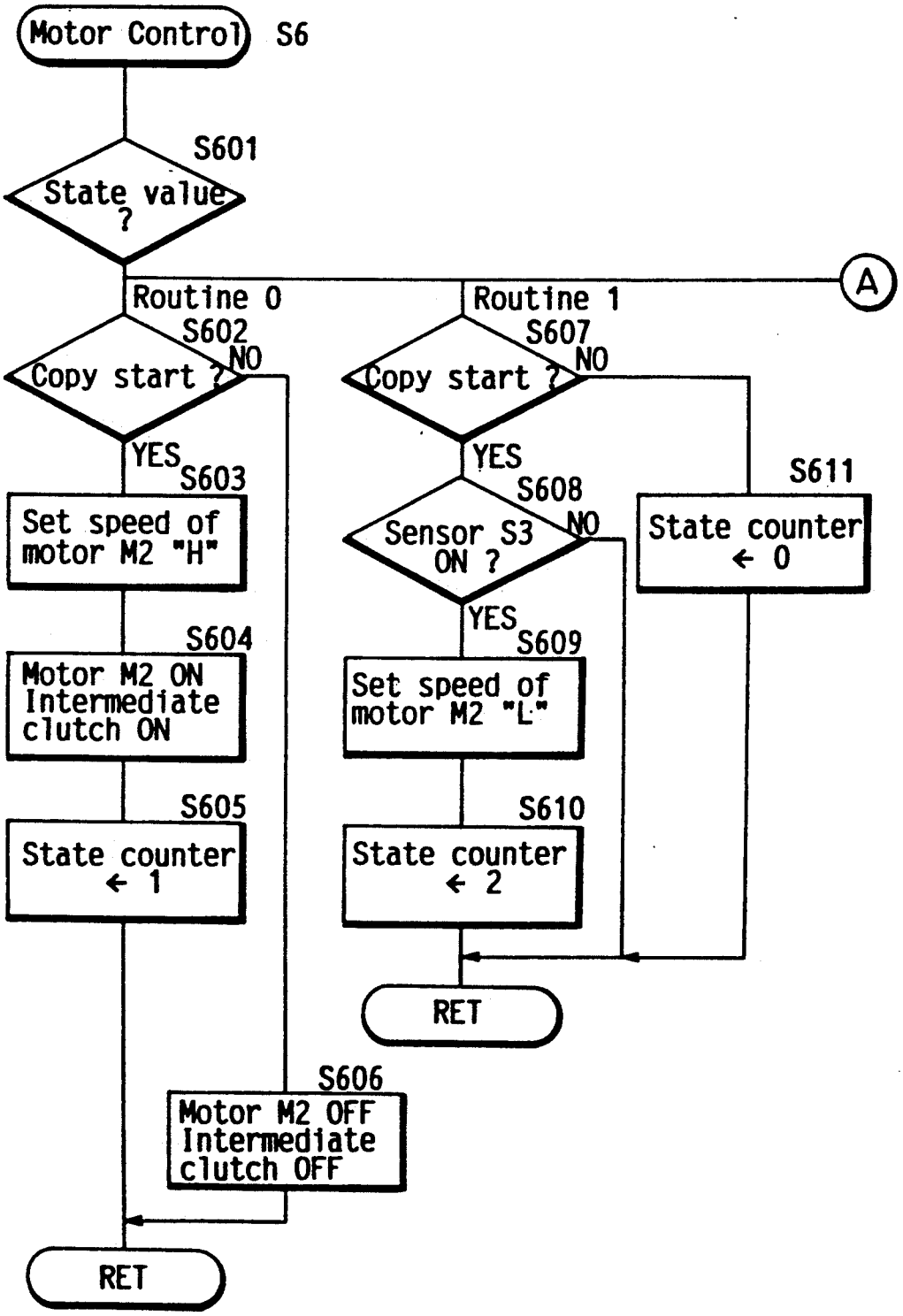
Figure 7B:
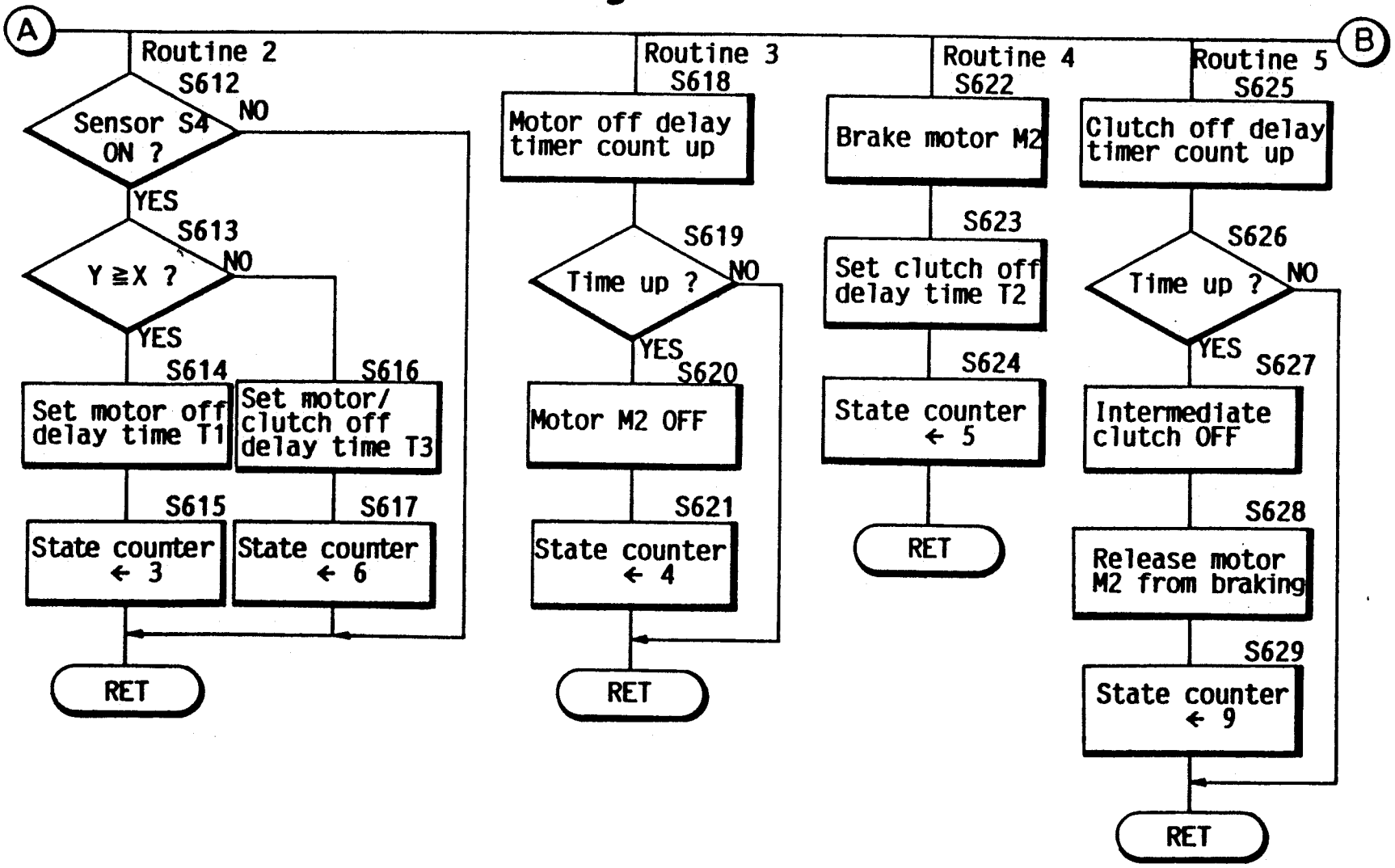
Figure 7C:
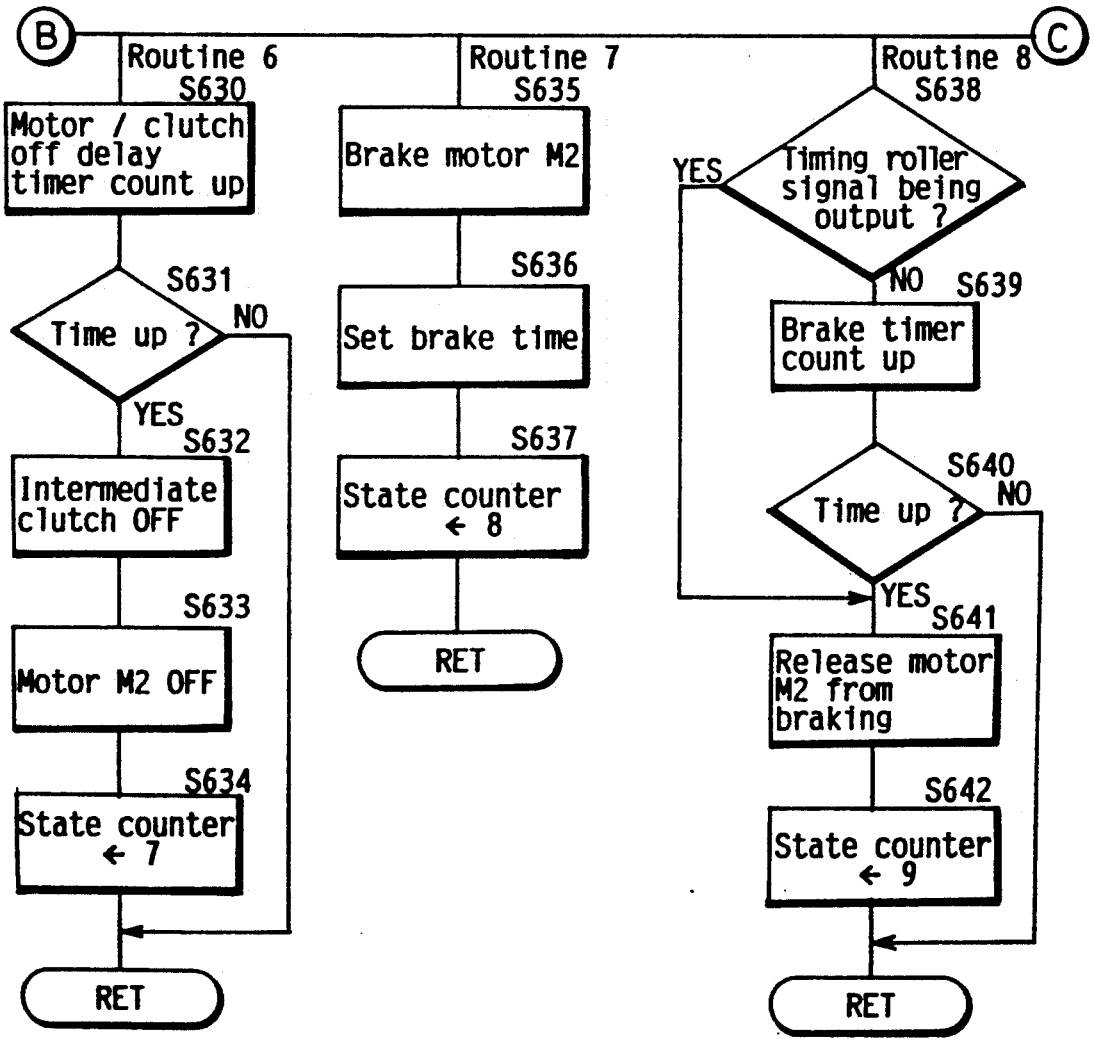
Figure 7D:
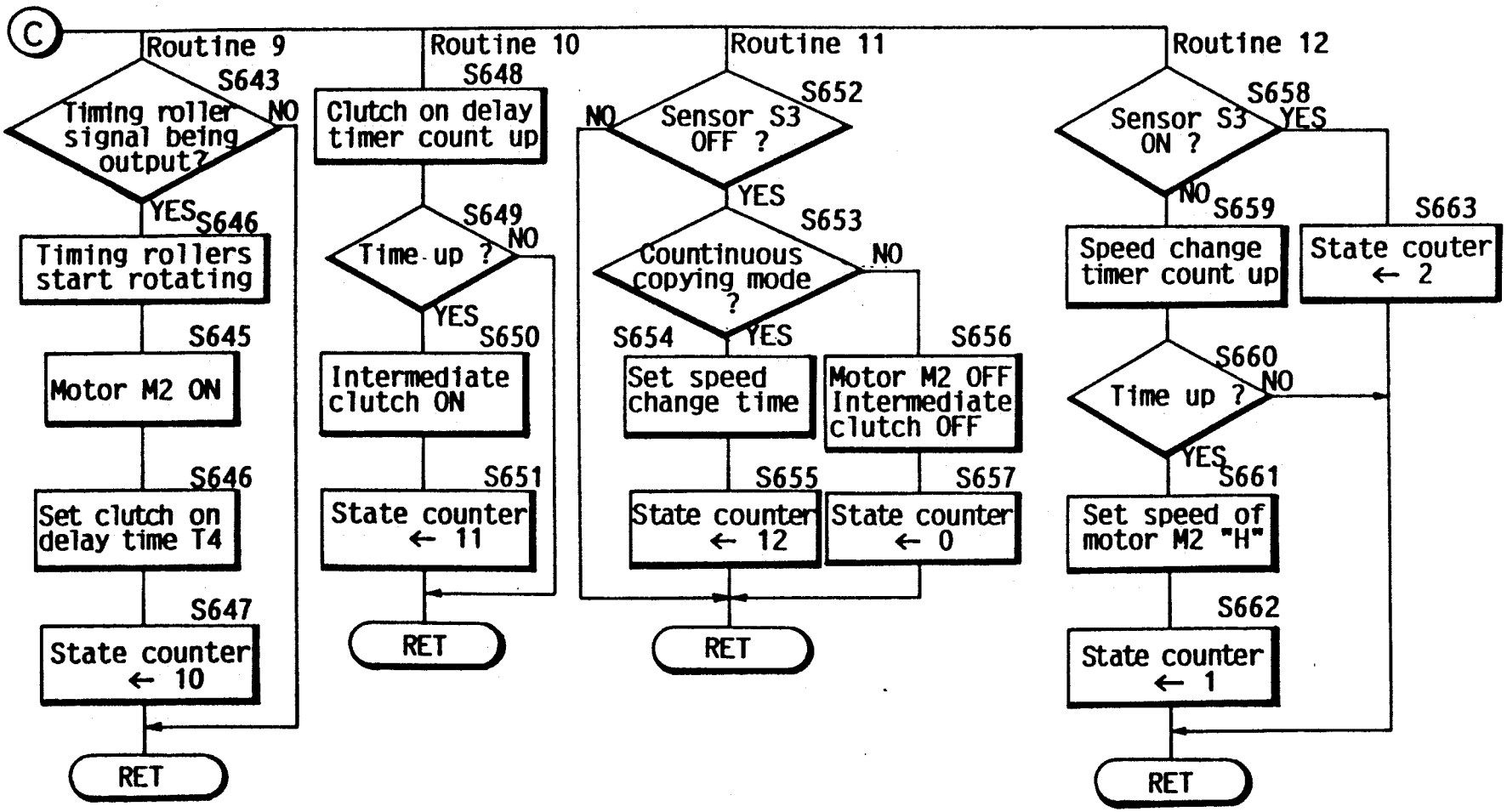

Control of the CPU 30 will be described specifically, referring to FIGS. 6 and 7. FIG. 6 is a flowchart of a main routine of the CPU 30 and FIG. 7 is a flowchart of a motor control subroutine for controlling the driving motor M2, etc.

In the main routine, when a power source is turned on or reset to start a program, the CPU 30 executes initialization including clear of a RAM (not shown) and setting of various timers which will be described later (S1). Then, a built-in timer for controlling an execution time of one loop is set (S2) to synchronize the operation of the CPU 30 with an operation of other CPUs (sub control section).

Figure 1A:
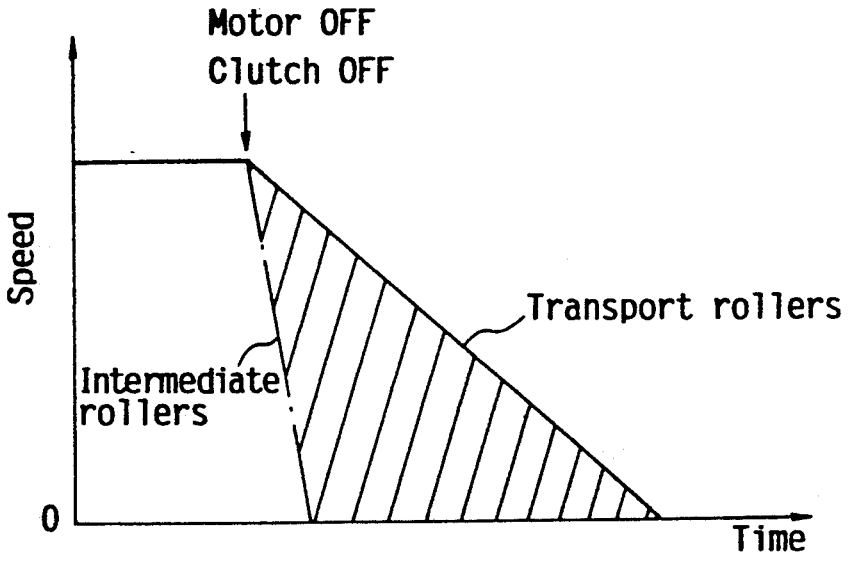
Fig. 1a Prior Art
FIG. 1*a* is a time chart showing change in the circumferential speeds of the transport rollers and the intermediate rollers when they are decelerating to a complete stop.
Figure 1B:
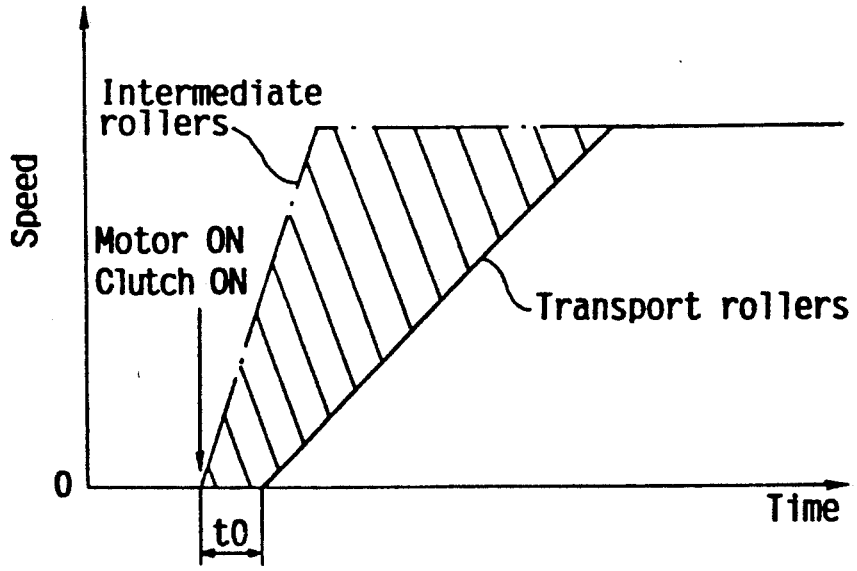
Fig. 1b Prior Art
FIG. 1*b* is a time chart showing change in the circumferential speeds of the transport rollers and the intermediate rollers when they are accelerating to a full speed.
Figure 2:
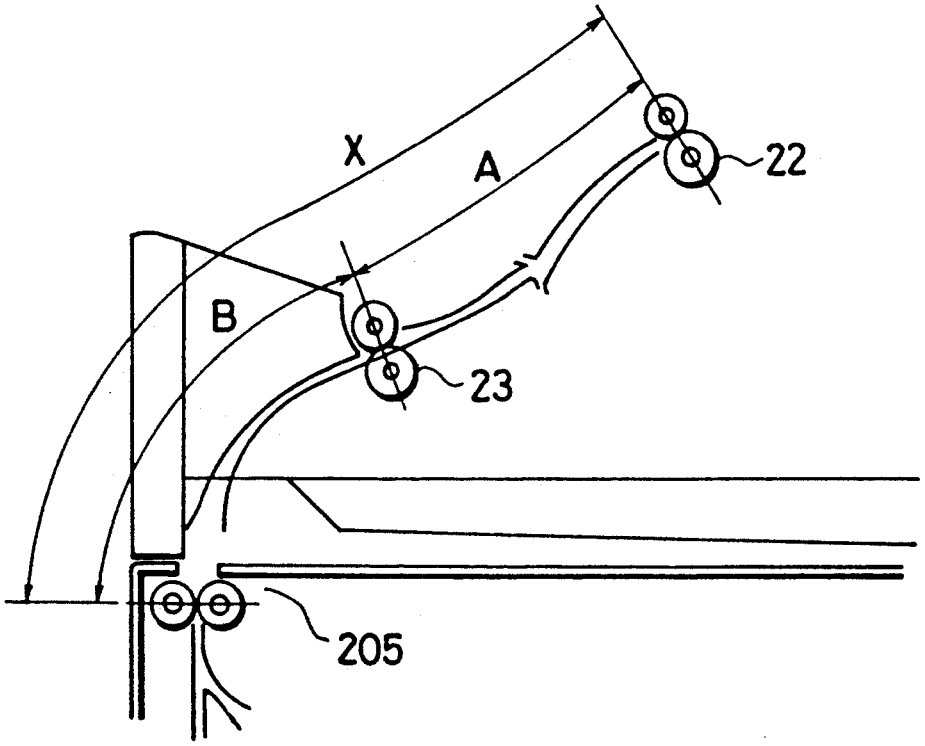
FIG. 2 is a cross sectional view showing a construction in the vicinity of the transport rollers and the intermediate rollers.
Figure 3A:
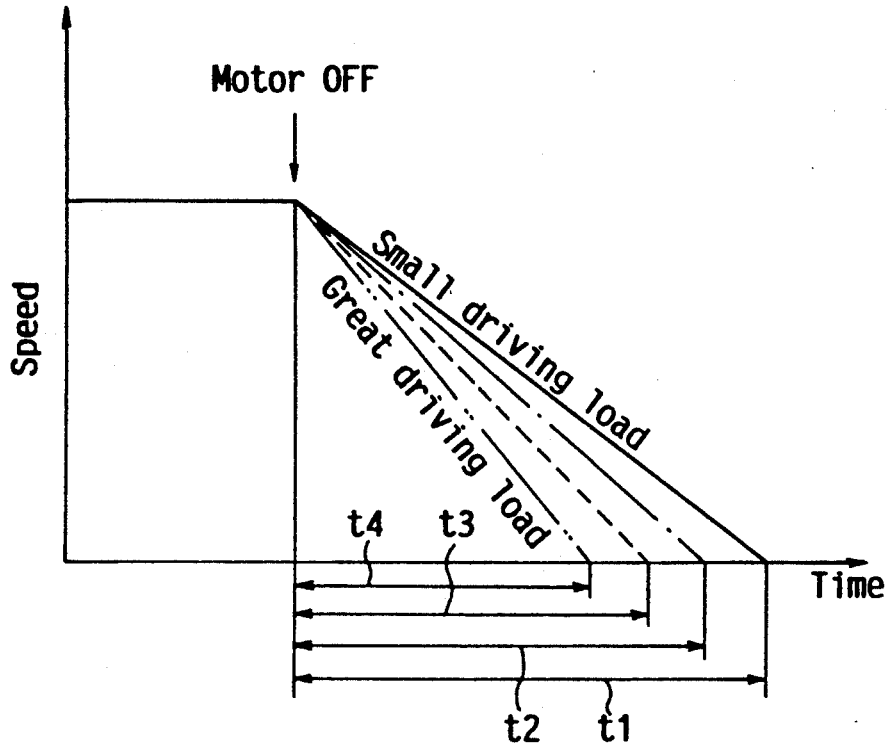
FIG. 3*a* is a time chart showing a relationship between the stopping point of the paper feeding cabinet driving motor and fluctuation in the driving load of the driving motor.
Figure 3B:
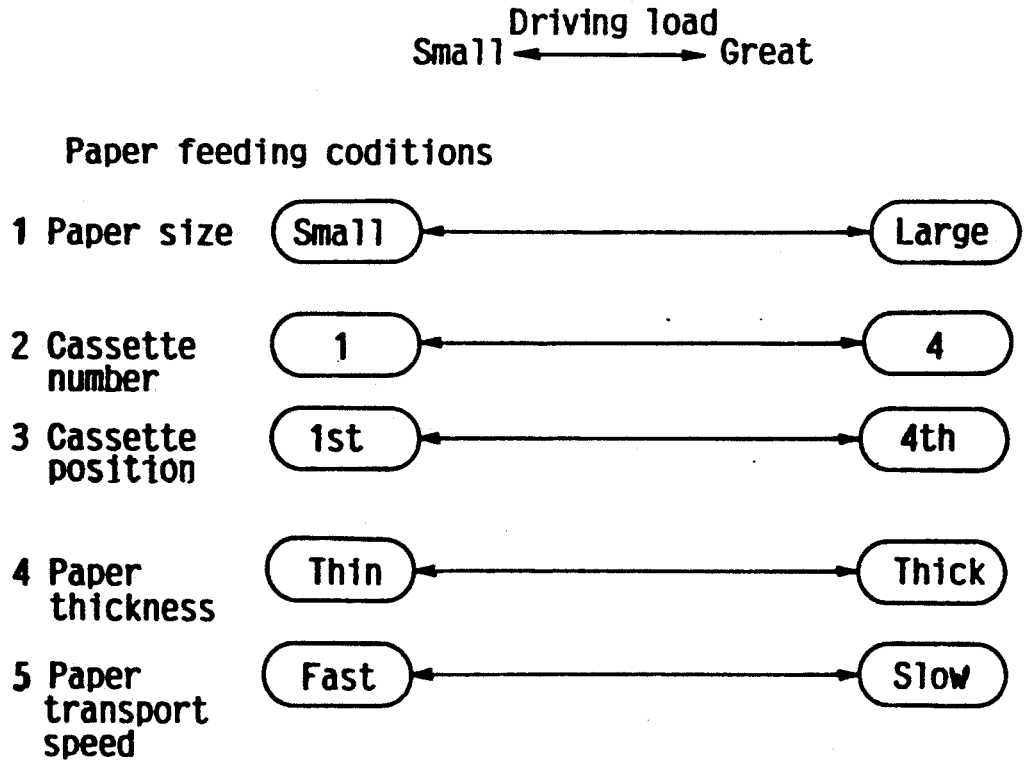
FIG. 3*b* is a view explaining a relationship between the paper feeding conditions and the driving load.

Next, information from the sensors shown in FIGS. 1 and 2 and key switches on the operation panel 40 and communication information from the above other CPUs are input (S3) and information for controlling a display section of the operation panel 40, etc. is output (S4).

Then, a recording paper is fed from the paper cassette 201 to the transport rollers 205 (S5: paper feeding control). In this step, distance between recording papers which are being transported from the paper feeding cabinet 200 to the main body 100, transport timing of the recording papers and a jamming detection timer for checking transport error are also set.

After step S5, a motor control subroutine for controlling the driving motor M2, etc. is executed (S6) and a copying operation follows (S7). Then, other operations such as communication with the above other CPUs are executed (S8) and completion of the time set in the built-in timer is awaited (S9). If the time is up in step S9, the program goes back to step S2 and repeats the operations of step S2 through S9.

Motor Control Subroutine

The motor control subroutine of step S6 will be described in detail, referring to FIGS. 7 through 9.

First, on/off timing control of the driving motor M2 and the intermediate clutch 31 in the case where the recording paper is held by the transport rollers 205 and intermediate rollers 23 will be explained below.

Figure 8A:
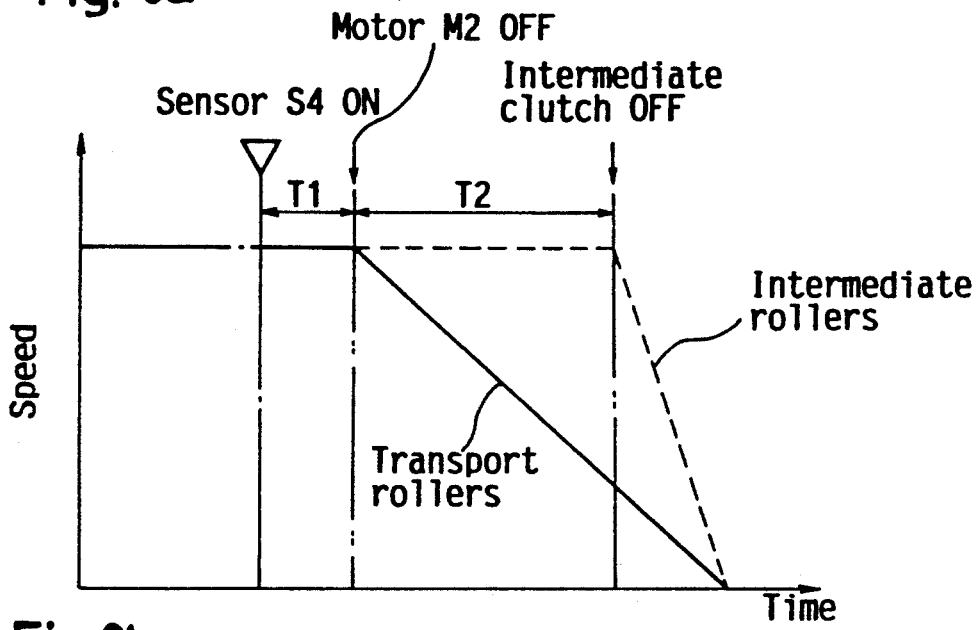
FIGS. 8*a* and 8*b* are time charts, each showing change in the circumferential speeds of the transport rollers and the intermediate rollers when they are decelerating to a complete stop in Embodiment 1.

Timing for turning off the driving motor M2 and the intermediate clutch 31 is controlled in accordance with whether or not the length Y of the recording paper is X or more.

Where the length Y is X or more, as shown in FIG. 8*a*, the driving motor M2 is turned off when a motor off delay time T1 has passed since the sensor S4 is turned on and the intermediate clutch 31 is turned off when a clutch off delay time T2 has passed since the driving motor M2 is turned off. The sensor S4 is turned on when it detects the leading end of the recording paper.

The clutch off delay time T2 is set so that the transport rollers 205 and the intermediate rollers 23 are stopped at the same time. In this case also, tension is applied to the recording paper until the intermediate rollers 23 are stopped. However, since this tension is slight and does not act rapidly, it hardly affects the recording paper.

The motor off delay time T1 is set so that a distance by which the recording paper is transported from the time when the sensor S4 is turned on till the transport rollers 205 and the intermediate rollers 23 are stopped is a little longer than the distance between the sensor S4 and the timing rollers 22. Therefore, the recording paper is transported by a short distance after the leading end thereof reached the timing rollers 22, whereby the recording paper is appropriately curved between the intermediate rollers 23 and the timing rollers 22. This is effective to securely contact the recording paper on the timing rollers 22, thereby preventing the recording paper from being skewed.

Figure 8B:
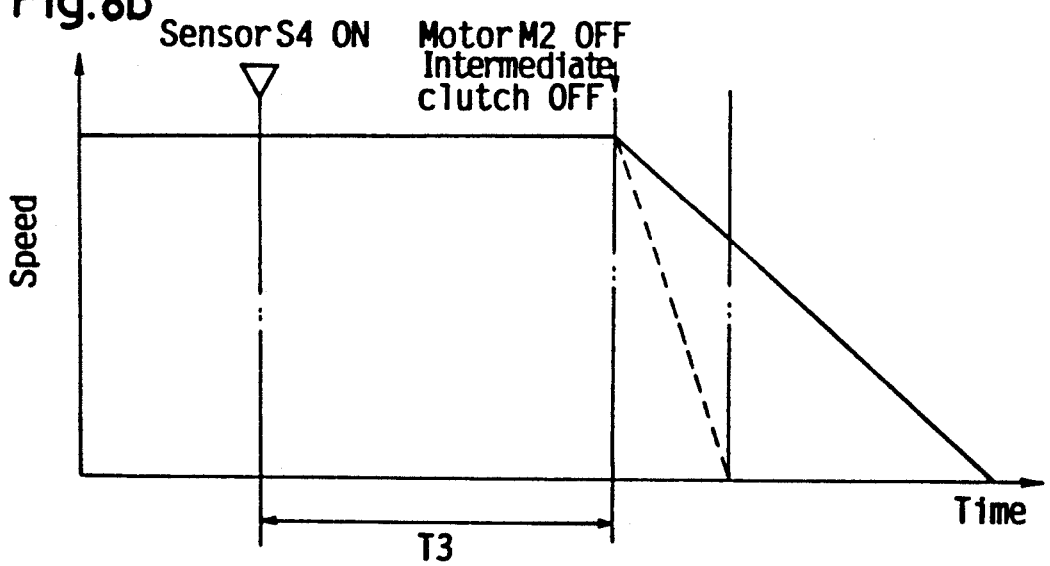

On the other hand, where the length Y of the recording paper is less than X, as shown in FIG. 8*b*, the driving motor M2 and the intermediate clutch 31 are turned off at the same time when a motor/clutch off delay time T3 has passed since the sensor S4 is turned on.

The above motor/clutch off delay time T3 is set to the sum of the motor off delay time T1 and the clutch off delay time T2 in order to prevent the recording paper being skewed. In this case, the recording paper is not curved between the intermediate rollers 23 and the transport rollers 205 even if the transport rollers are stopped later than the intermediate rollers 23 since the driving motor M2 and the intermediate clutch 31 are turned off after the trailing end of the recording paper passes the transport rollers 205. In a continuous copying mode, the intermediate clutch 31 and the driving motor M2 may be controlled in the same way as in the case where Y is X or more.

Figure 9:
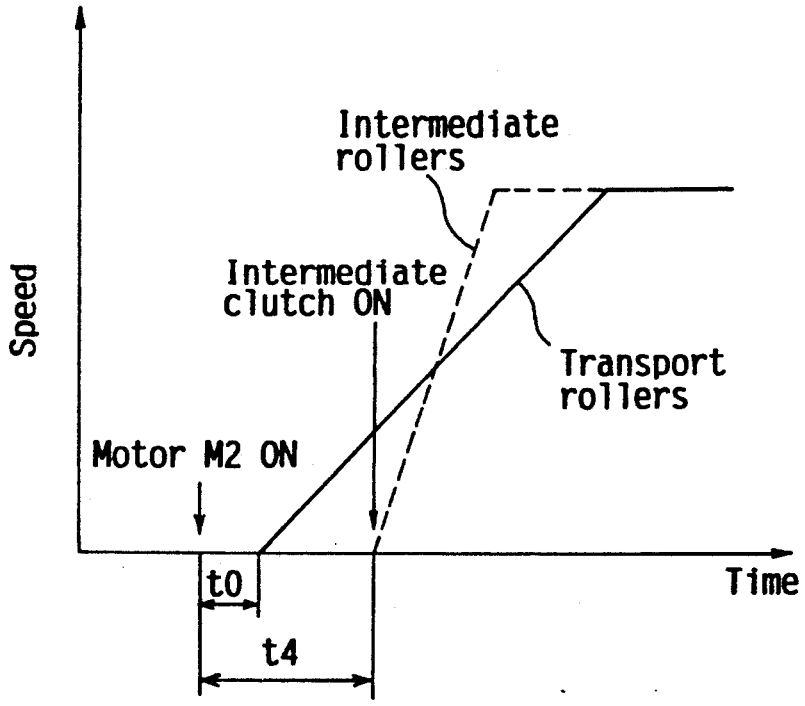
FIG. 9 is a time chart showing change in the circumferential speeds of the transport rollers and the intermediate rollers when they are accelerating to a full speed in Embodiment 1.
Figure 10:
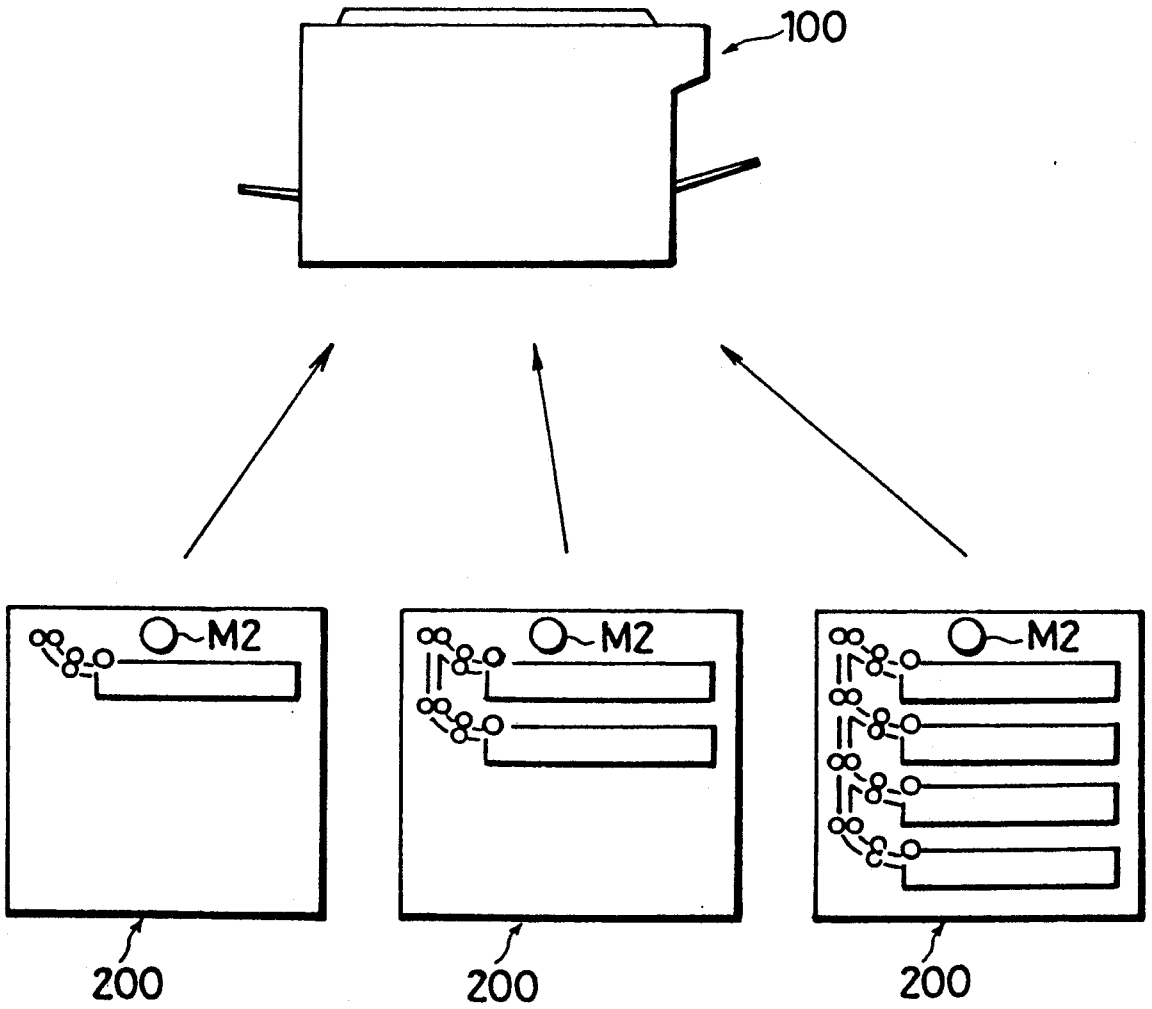
FIG. 10 is a cross sectional view of paper feeding cabinets having different numbers of paper cassettes, one of the cabinets being combined with a main body of a copier in Embodiment 2, FIG. 11(*a–d*) are a flowchart of a motor control subroutine for controlling a driving motor M2, etc. in Embodiment 2.
Figure 11A:
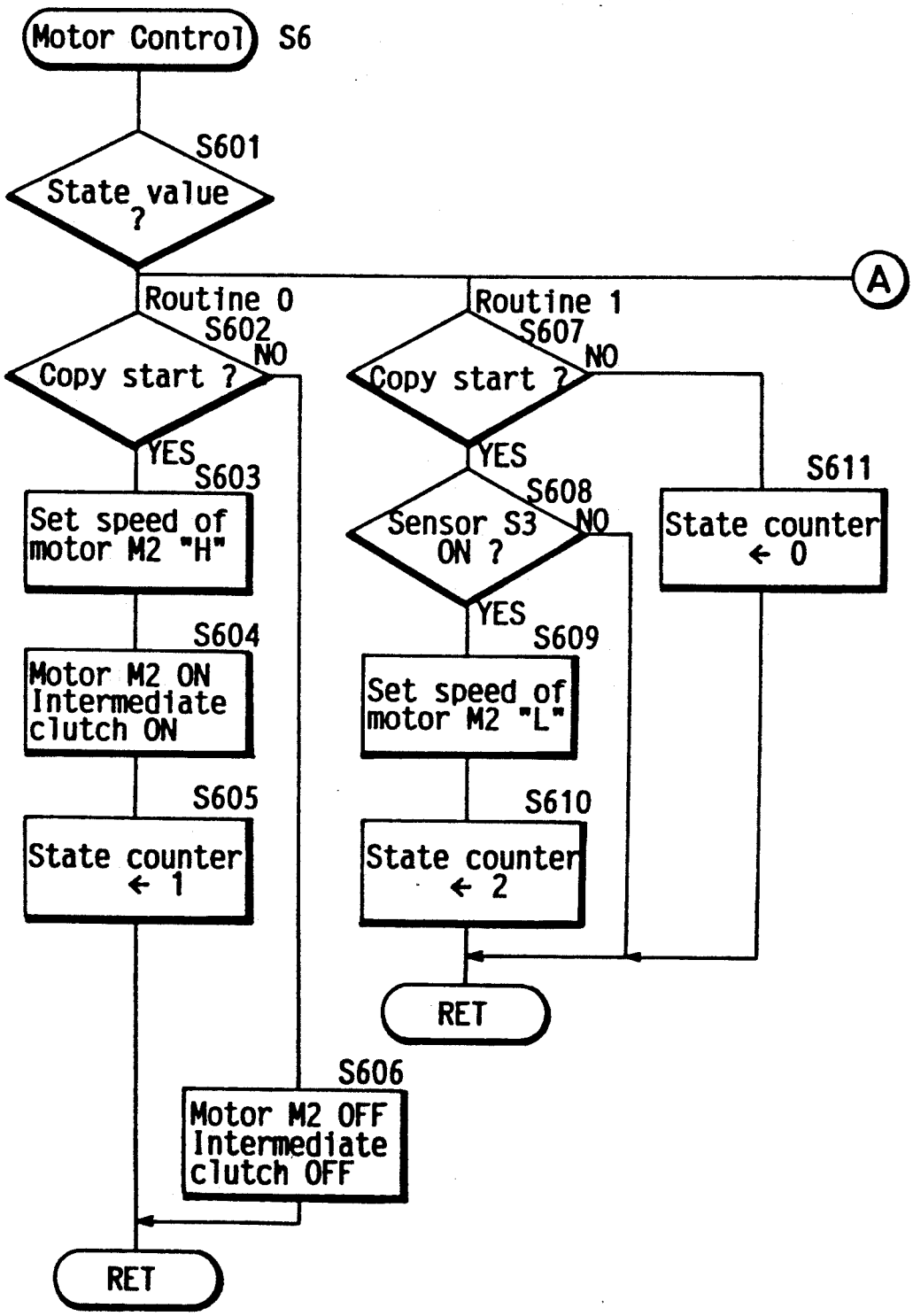
Figure 11B:
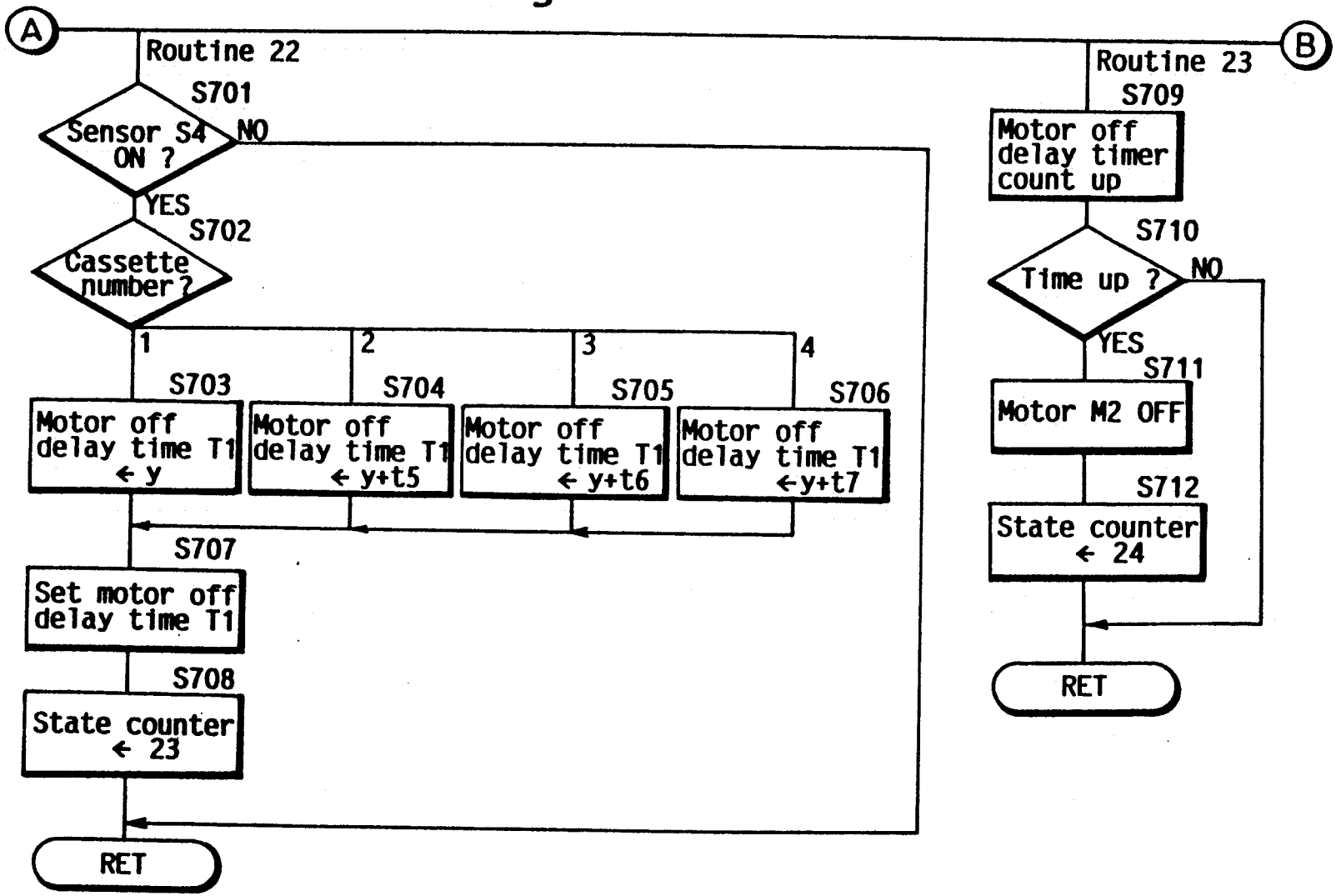
Figure 11C:
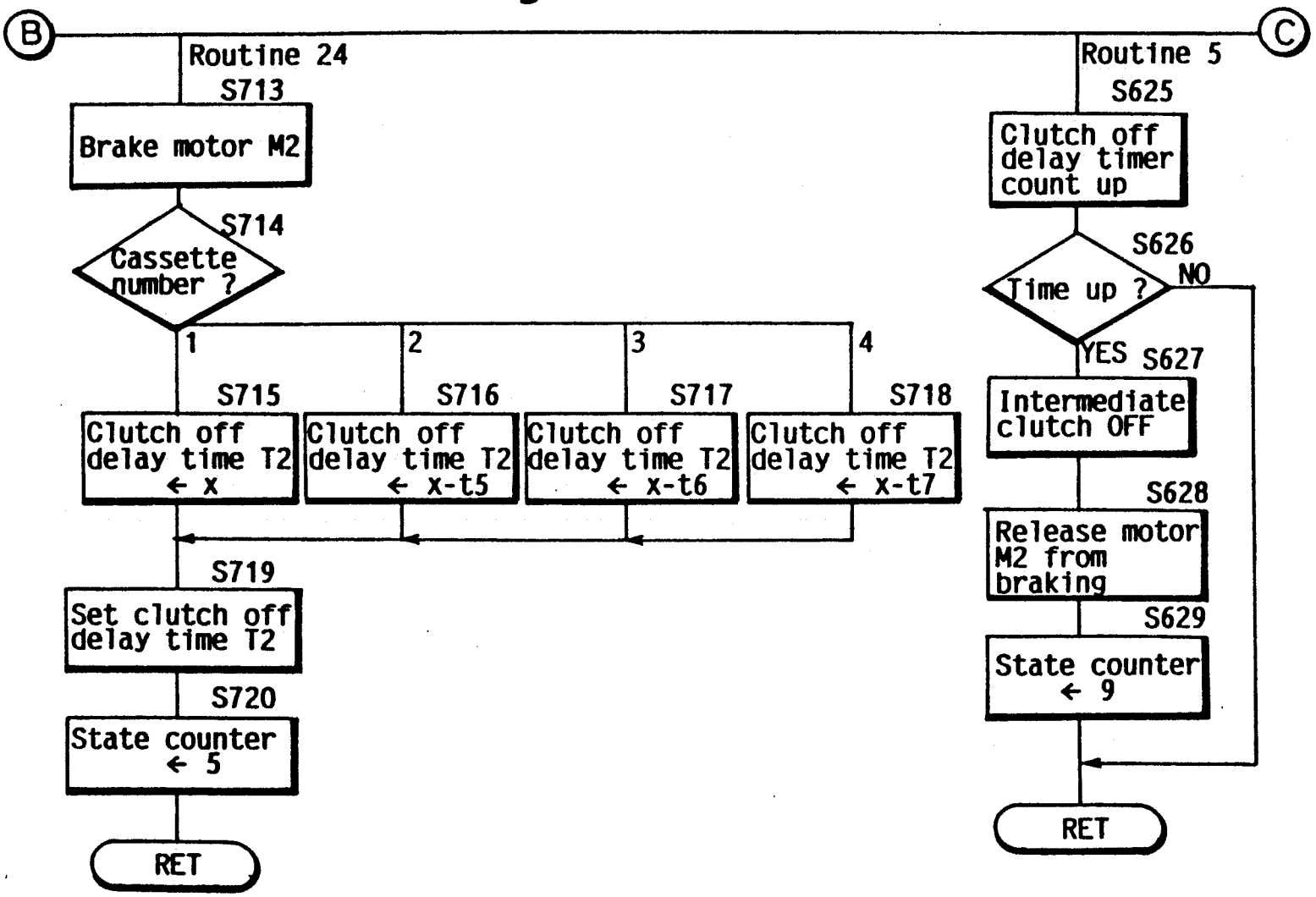
Figure 11D:
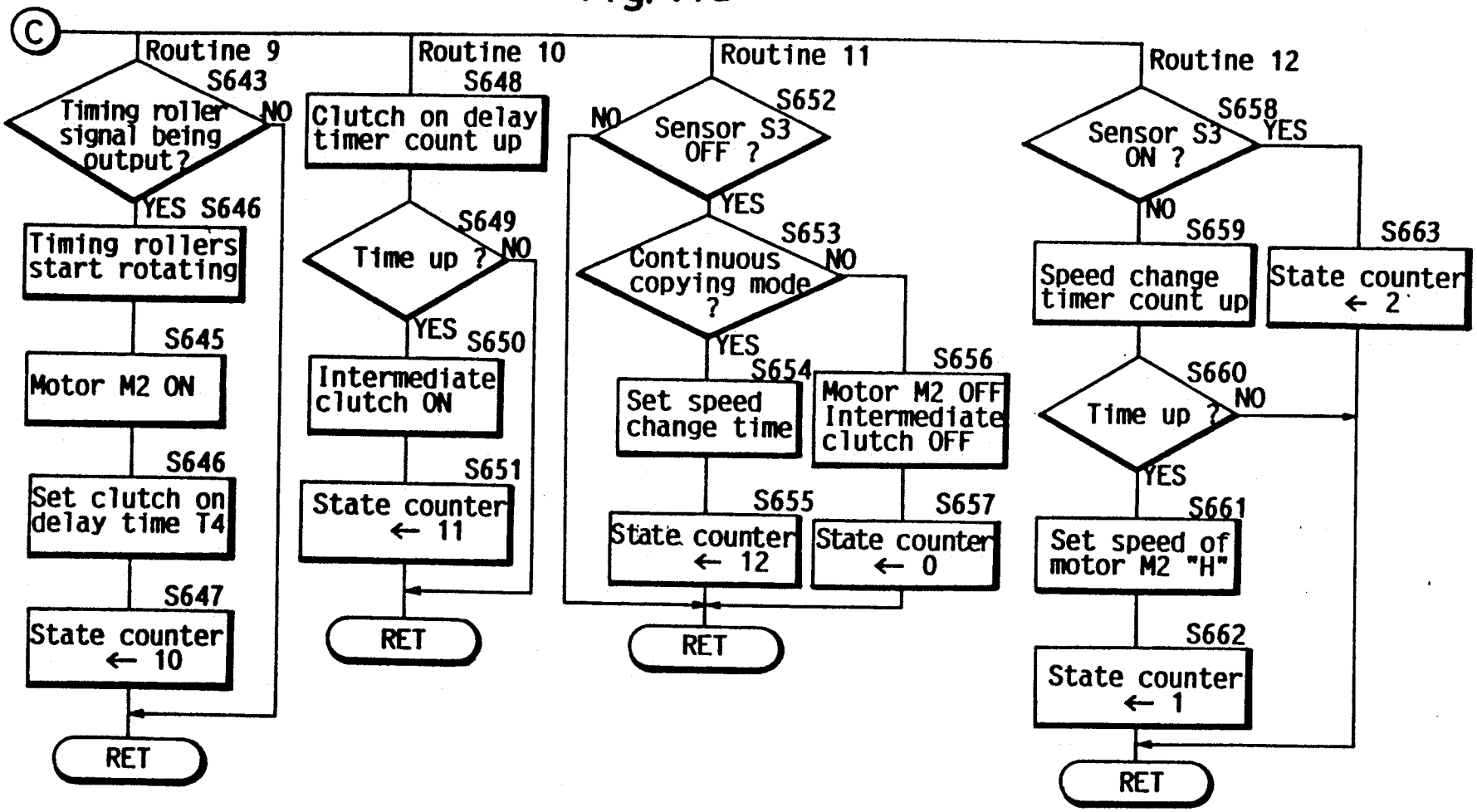

In restarting the transport of the recording paper which has been stopped being held by the transport rollers 205 and the intermediate rollers 23, as shown in FIG. 9, the driving motor M2 is turned on first and the intermediate clutch 31 is turned on when a clutch on delay time T4 has passed since the driving motor M2 is turned on regardless of the length Y of the recording paper.

The clutch on delay time T4 is set so that the circumferential speed of the transport rollers 205 and that of the intermediate rollers 23 becomes the same at the middle point between the time when the transport rollers 205 start rotating and the time when the speed of the transport rollers 205 reaches a predetermined speed. That is, the recording paper starts to be curved when the transport rollers 205 start rotating, and starts to be stretched when the intermediate rollers 23 start rotating. When the transport rollers 205 start rotating at the predetermined speed, the recording paper becomes flat completely with no tension applied thereto.

Next, practical operation in the motor control subroutine will be described below.

In this subroutine, which of 0–12 is a state value of a state counter is judged in step S601. The program goes to one of routines 0–12 in accordance with the judgment result.

The state value of the above state counter is set to 0 in the initialization in step S1. The state value is changed in each of the routines 0–12, whereby to which routine the program is to go in the next loop is determined.

The routines 1–12 will be explained sequentially.

In the routine 0, whether the copying operation has started or not is judged in step S602 on the basis of turn-on or turn-off of a copy key. If so, the rotating speed of the driving motor M2 is set to "H" (S603). Then, the remote signal 35 is output to the drive IC 33 and the intermediate clutch 31 is turned on (S604). Thus, the driving motor M2 starts rotating at the speed "H". Then, the state value of the state counter is set to 1 (S605) and the program returns to the main routine.

On the other hand, if the copying operation has not been started at step S602, output of the remote signal 35 is stopped and the intermediate clutch 31 is turned off (S606) and the program returns to the main routine.

The speed "H" is a speed higher than the system speed (image forming speed) of the main body 100. Since the transport speed has no relation to the system speed until the leading portion of the recording paper reaches the intermediate rollers 23, the recording paper is transported to the intermediate rollers at the speed "H" to shorten the time required to feed the recording paper, thereby improving the copying operation efficiency. The transport of the recording paper to the intermediate rollers 23 at the speed "H" is most effective when the recording paper is fed from the lowermost paper cassette 204 shown in FIG. 1.

The rotating speed of the driving motor M2 can also be set to "L" corresponding to the system speed. The driving motor M2 is changed over between the speed "H" and the speed "L" when necessary by changing the frequency of the clock signal described before.

Where the paper feeding cabinet 200 has a construction applicable to various types of main bodies whose system speeds are different from each other, the speed "L" may be automatically set, for example, by detecting the system speed by a detection device.

In the routine 1, the rotating speed of the driving motor M2 is changed over from the speed "H" to the speed "L".

In step S607, whether the copying operation has been started or not is judged. If so, whether the sensor S3 is on or not is judged (S608). If the sensor S3 is on, the rotating speed of the driving motor M2 is changed to "L" so that the speed of the transport rollers 205 becomes the same as that of the intermediate rollers 23 (S609). Then, the state value is set to 2 (S610) and the program returns to the main routine.

On the other hand, if the sensor S3 is off in step S608, it means that the recording paper has not been reached the intermediate rollers 23 yet. Therefore, the program returns to the main routine without changing the rotating speed of the driving motor M2.

Further, if the copying operation has not been started in step S607, the state value is reset to 0 (S611) and the program returns to the main routine.

In the routine 2, when the leading end of the recording paper has reached the sensor S4, either of the motor off delay time T1 and the motor/clutch off delay time T3 is set in accordance with the recording paper size, that is, the length Y.

First, whether the sensor S4 is on or not is judged in step S612. If so, whether or not the length Y of the recording paper is X or more is judged on the basis of the detection signal from the paper size detecting sensor 251 (S613).

When the length Y is X or more, the motor off delay time T1 for turning off the driving motor M2 is set in a motor off delay timer (S614). Then, the state value is set to 3 (S615) and the program returns to the main routine.

On the other hand, if the length Y is less than X, the motor/clutch off delay time T3 for turning off the driving motor M2 and the intermediate clutch 31 at the same time is set in a motor/clutch off delay timer (S616). Then, the state value is set to 6 (S617) and the program returns to the main routine.

If the sensor S4 is off in step S612, the program returns to the main routine.

It is to be noted here that each of the above motor off delay timer, motor/clutch off delay timer and other timers which will be described later counts up the number of loops of the main routine. Time-up of each timer means that the counted up value has reached the value set as a delay time.

The routines 3–5 are executed when the length Y is X or more (S613:YES).

In the routine 3, the motor off delay timer counts up the number of loops (S618) and whether or not the time set in the timer is up is judged (S619). If the time is up in step S619, the output of the remote signal 35 is stopped to turn off the driving motor M2 (S620) and the state value is set to 4 (S621). Then, the program returns to the main routine. If the time is not up in step S619, the program returns to the main routine.

In the routine 4, the brake signal 36 is output to the driving motor M2 (S622) in order to stop the driving motor M2 quickly.

Next, the clutch off delay time T2 for turning off the intermediate clutch 31 is set in a clutch off delay timer (S623) and the state value is set to 5 (S624). Then, the program returns to the main routine.

In the routine 5, the intermediate clutch off delay timer counts up the number of loops (S625) and whether or not the time set in the timer is up is judged (S626).

If the time is up in step S626, the intermediate clutch 31 is turned off at that point, that is, the clutch off delay time T2 after the turn-off of the driving motor M2 (S627). Then, the output of the brake signal 36 to the driving motor M2 is stopped (S628) and the state value is set to 9 (S629). Thereafter, the program returns to the main routine.

If the time is not up in step S626, the program returns to the main routine.

The routines 6–8 are executed when the length Y is less than X (S613: NO).

In the routine 6, the motor/clutch off delay timer counts up the number of loops (S630) and whether or not the time set in the timer is up is judged (S631). If the time is up, the intermediate clutch 31 is turned off (S632) and the output of the remote signal 35 is stopped to turn off the driving motor M2 (S633). Then, the state value is set to 7 (S634) and the program returns to the main routine. If the time is not up in step S631, the program returns to the main routine.

In the routine 7, the brake signal 36 is output to the driving motor M2 (S635) and a brake time is set in a brake timer (S636). Then, the state value is set to 8 (S637) and the program returns to the main routine.

In the routine 8, the state of a timing roller signal for driving the timing rollers 22 is checked (S638). If the timing roller signal is being output, the output of the brake signal 36 is stopped (S641) and the state value is set to 9 (S642) in order to transport the recording paper to the transfer charger 5 with the progress of the copying operation.

If the timing roller signal is not being output in step S638, the brake timer counts up the number of loops (S639) and whether or not the time set in the timer is up is judged (S640). If the time is up, the program goes to step S641 judging that the brake signal 36 has been output for an enough period. If the time is not up in step S640, the program returns to the main routine.

In the routines 9 and 10, the transport of the recording paper is restarted to transport the recording paper to the transfer charger 5.

In the routine 9, the state of the timing roller signal is checked (S643), first. If the timing roller signal is being output, a clutch (not shown) for connecting the main motor M1 with the timing rollers 22 is engaged to rotate the timing rollers 22 (S644), whereby the transport of the recording paper is restarted. Then, the remote signal 35 is output to turn on the driving motor M2 (S645) and the clutch on delay time T4 for delaying the turn-on of the intermediate clutch 31 is set in a clutch on delay timer (S646). Thereafter, the state value is set to 10 (S647) and the program returns to the main routine. If the timing roller signal is not being output in step S643, the program returns to the main routine.

As described before, if the intermediate clutch 31 and the driving motor M2 are turned on at the same time, the intermediate rollers 23 starts rotating earlier than the transport rollers 205 due to the difference in the moment of inertia between them, whereby the recording paper is drawn rapidly and applied great tension or skewed. Therefore, in the above process, the intermediate clutch 31 is turned on later than the driving motor M2.

In the routine 10, the clutch on delay timer counts up the number of loops (S648) and whether or not the time set in the timer is up is judged (S649). If the time is up, the intermediate clutch 31 is turned on to drive the intermediate rollers 23 at that point (S650), that is, the clutch on delay time T4 after the turn-on of the driving motor M2. Then, the state value is set to 11 (S651) and the program returns to the main routine. If the time is not up in step S649, the program returns to the main routine.

In the routines 11 and 12, a recording paper to be fed next is transported in the continuous copying mode.

In the routine 11, whether or not the sensor S3 is off, that is, whether or not the trailing end of the recording paper has passed the sensor S3 is judged (S652). If the sensor is off, whether or not the copying operation is to be continued is judged (S653).

If the copying operation is to be continued, a predetermined time for setting the speed of the driving motor M2 to "H" is set in a speed change timer of the driving motor M2 (S654). The speed of the driving motor M2 is set to "H" in order to improve the copying operation efficiency and to compensate delay in the transport of the next recording paper. Then, the state value is set to 12 (S655) and the program returns to the main routine.

If the copying operation is not to be continued in step S653, the output of the remote signal 35 is stopped to turn off the driving motor M2 and the intermediate clutch 31 is turned off (S656). Then, the state value is set to 0 (S657) and the program returns to the main routine. If the sensor S3 is on in step S652, the program returns to the main routine.

In the routine 12, whether or not the sensor S3 is on is judged (S658). If so, the state value is set to 2 (S663) to execute the next copying cycle and the program returns to the main routine.

If the sensor S3 is off in step S658, the speed change timer counts up the number of loops (S659) and whether or not the time set in the timer is up is judged (S660). If the time is up, it means that the next recording paper has not reached the sensor S3 after the lapse of the predetermined time. Therefore, the speed of the driving motor M2 is set to "H" (S661) to fasten the transport speed of the next recording paper. Then, the state value is set to 1 (S662) and the program returns to the main routine. If the time is not up in step S660, the program returns to the main routine.

As described above, according to this embodiment, the transport rollers 205 and the intermediate rollers 23 can be stopped at the same time and driven at proper timings by setting the clutch off delay time T2 and clutch on delay time T4 as shown in FIGS. 8a and 9 even if the recording paper is held by the transport rollers 205 and the intermediate rollers 23.

The clutch off delay time T2 is not limited to the value shown in the drawing and may be set to another value in accordance with the construction of the transport path of the recording paper or the like. For example, the time T2 may be set to such a value that an appropriate curved portion is formed in the recording paper within a range corresponding to B in FIG. 2.

Where the clutch off delay time T3 is set as in the above embodiment, the recording paper is prevented from being curved. Although the recording paper is gradually applied tension from the time when the output of the remote signal 35 is stopped till the intermediate rollers 23 are stopped, this tension does not affect the recording paper, as described before. If necessary, such tension can be prevented completely by using a one-way clutch.

Where the clutch on delay time T4 is set as in the above embodiment, the recording paper is prevented from being applied tension without using a one-way clutch and curving of the recording paper is restricted. If a one way clutch is provided in the rotating axes of the transport rollers 205 and the clutch on delay time T4 is set shorter, the curving of the recording paper is further restricted. In this case also, great tension is not applied to the recording paper since the difference between the speed of the transport rollers and that of the intermediate rollers does not become large as compared with the case in which the driving mot or M2 and the intermediate clutch is turned on at the same time.

Embodiment 2

Another embodiment of the present invention will be described hereinafter. In this embodiment, the main body 100 and the motor driving circuit have the same construction as Embodiment 1 and their explanation is eliminated. Any one of multiple paper feeding cabinets 200 respectively containing different numbers of paper cassettes is selected by an user for combination with the main body 1.

In addition, the operation of the CPU 30 is the same as in Embodiment 1 except a part of the motor control subroutine (S6) wherein the driving motor M2 and the intermediate clutch 31 are controlled in accordance with the number of paper cassettes contained in the paper feeding cabinet 200 (cassette number).

Motor Control Subroutine

FIG. 11 is a flowchart of a motor control subroutine for controlling the driving motor M2, etc.

In this subroutine, as in Embodiment 1, the program goes to any one of routines 0, 1, 22–24, 5 and 9–12 in accordance with the state value of the state counter in step S601. The routines 0, 1, 5, 9–12 are the same as Embodiment 1 and so, explanation is eliminated here using the same step numbers for the same steps. In Embodiment 2, routines 22–24 are executed instead of the routines 2–4 in Embodiment 1. The routines 22–24 will be explained below.

First, on/off timing control of the driving motor M2 and the intermediate clutch 31 will be explained.

The motor off delay time T1 is set in accordance with the cassette number with which the driving load of the driving motor M2 is varied.

That is, the more the cassette number is, the greater the driving load is. Accordingly, both the time between turn-off the driving motor M2 and stop of the driving motor M2 (referred to as stop time hereinafter) and the distance by which the recording paper is transported during the stop time become shorter with increase of the cassette number.

Figure 12:
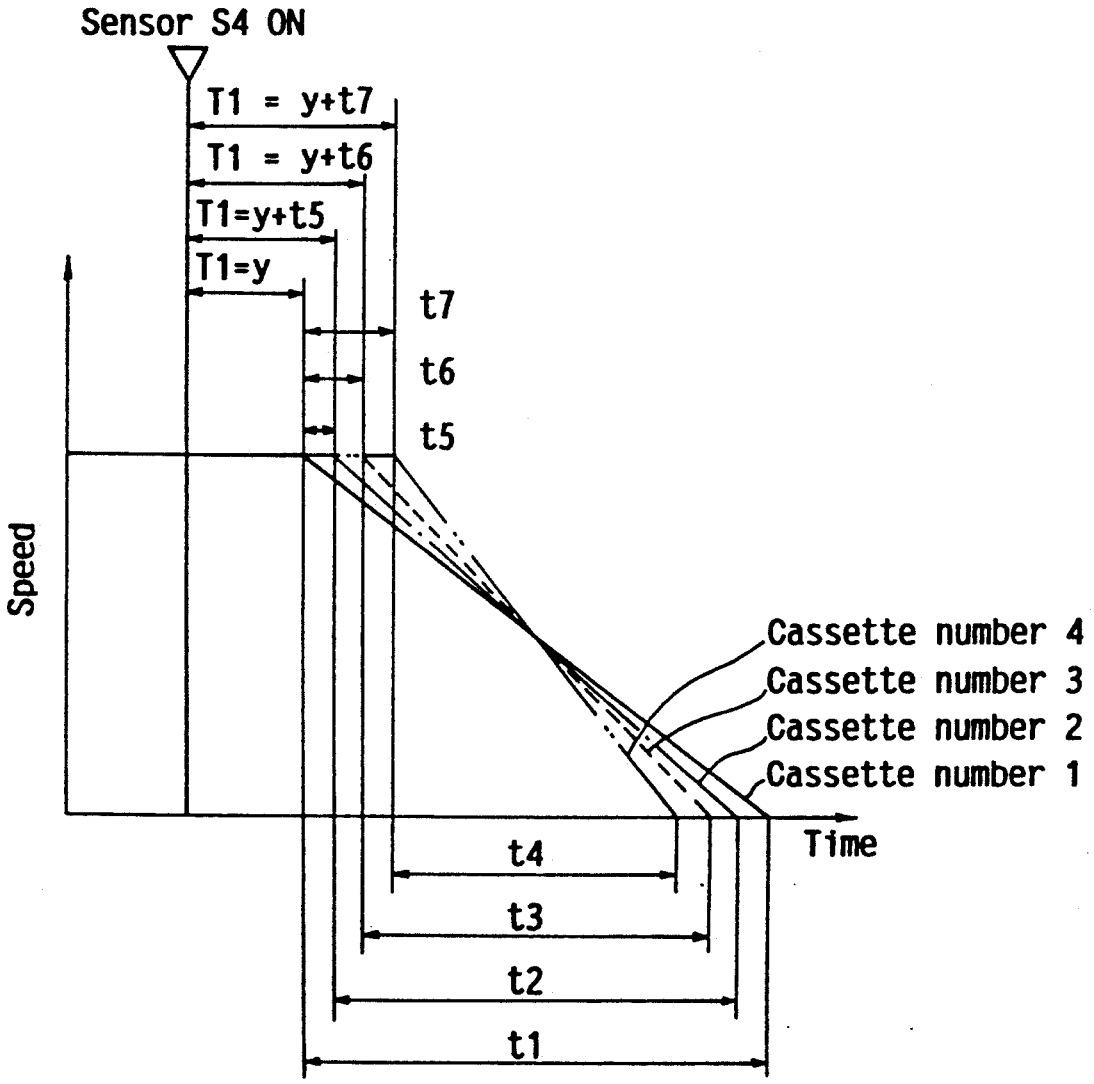
FIG. 12 is a time chart showing a relationship between the circumferential speed of the transport rollers and the driving load of the driving motor M2 when they are decelerating to a full stop in Embodiment 2.

As shown in FIG. 12, providing that the stop time and the motor off delay time T1 for one paper cassette are respectively t1 and y, for two paper cassettes t2 and y+t5, for three paper cassettes t3 and y+t6 and for four paper cassettes t4 and y+t7, the distance by which the recording paper is transported from turn-on of the sensor S4 to stop of the driving motor M2 is kept constant by setting t5 to t7 as t5=(t1−t2)/2, t6=(t1−t3)/2 and t7=(t1−t4)/2.

Therefore, the recording paper can be stopped so that its leading portion is at a fixed position with respect to the timing rollers 22. Further, in a continuous copying mode, the distance between the recording papers can be kept same, which prevents the preceding recording paper from being bumped by the following recording paper.

In addition, if t5 to t7 are set as t5=t1−t2, t6=t1−t3 and t7=t1−t4, the stopping point of the driving motor M2 is kept constant as in Embodiment 1 irrespective of the paper feeding conditions.

If there is a time lag between the time when the output of the remote signal 35 is stopped and the time when the speed of the driving motor M2 practically starts to be reduced, the value of y may be smaller.

On the other hand, the clutch off delay time T2 is set so that the distance by which the recording paper is transported from the turn-on of the sensor S4 to stop of the intermediate rollers 23 is kept constant.

Figure 13:
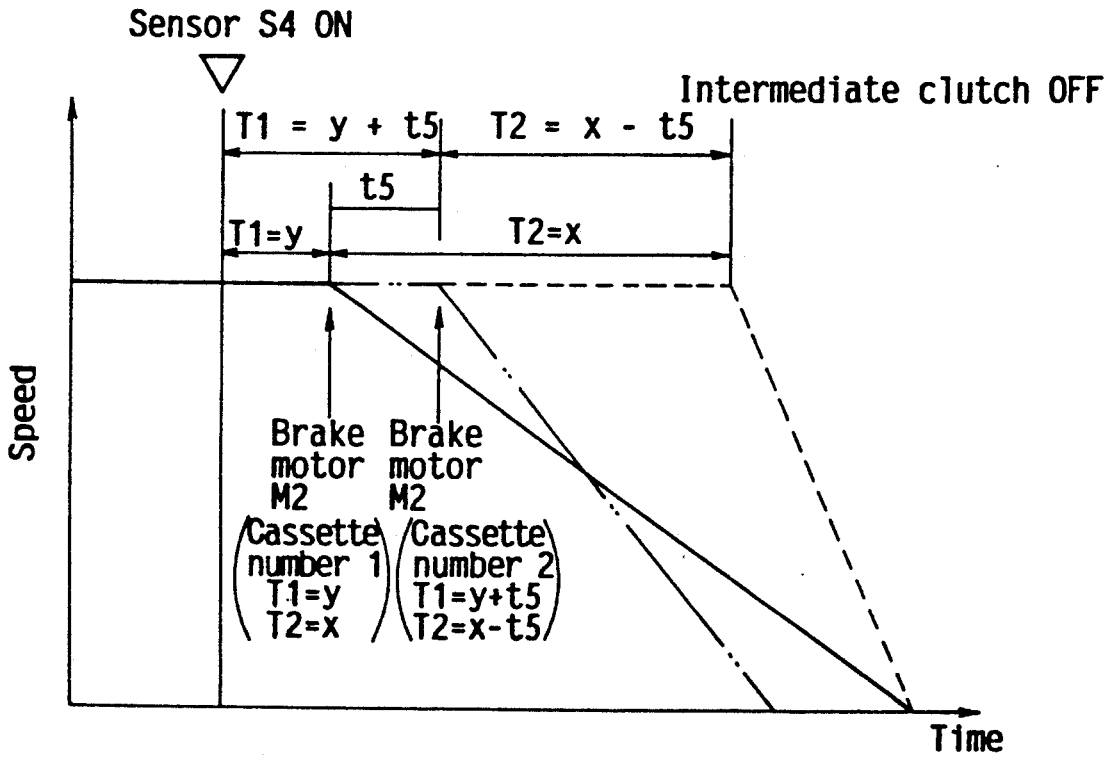
FIG. 13 is a time chart showing a relationship between the circumferential speeds of the intermediate rollers and the transport rollers and the driving load of the driving motor M2 when they are decelerating to a complete stop in Embodiment 2.

As shown in FIG. 13, providing that the clutch off delay time T2 for one paper cassette is x, T1+T2 is kept constant by setting the clutch off delay time T2 for two, three and four paper cassettes as T2=x−t5, T2=x−t6 and T2=x−t7, respectively. According to this construction, the leading end of the recording paper is contacted on the timing rollers 22 securely as in Embodiment 1. This prevents the recording paper from being skewed.

Practical operation of the motor control subroutine will be explained, referring to FIG. 11.

In the routine 22, the motor off delay time T1 is set. First, whether or not the leading end of the recording paper has reached the timing rollers 22 is judged (S701) by detecting on or off of the sensor S4.

If so, the cassette number, which is previously input from the operation panel 40 by an operator (for example, when the operator sets the paper feeding cabinet 200 to the main body 100), is checked (S702) and the motor off delay time T1 is determined in accordance with the cassette number. That is, the motor off delay time T1 is determined to be y when the cassette number is one (S703), y+t5 when the cassette number is two (S704), y+t6 when the cassette number is three (S705) and y+t7 when the cassette number is four (S706).

The determined motor off delay time T1 is set in the motor off delay timer (S707) and the state value is set to 23 (S708). Then, the program returns to the main routine.

In the routine 23, the motor off delay timer counts up the number of loops (S709) as in the routine 3 in Embodiment 1. When the set time is up (S710: YES), the output of the remote signal 35 is stopped to turn off the driving motor M2 (S711) and the state value is set to 24 (S712). Then, the program returns to the main routine.

In the routine 24, the clutch off delay time T2 is set. First, the brake signal 36 is output to the driving motor M2 (S713) and the cassette number is checked (S714) to determine the clutch off delay time T2 in accordance with the number. That is, the clutch off delay time T2 is determined to be x when the cassette number is one (S715), x−t5 when the cassette number is two (S716), x−t6 when the cassette number is three (S717) and x−t7 when the cassette number is four (S718).

The determined clutch off delay time T2 is set in the clutch off delay timer (S719) and the state value is set to 5 (S720). Then, the program returns to the main routine.

The driving motor M2 may be driven in accordance with other paper feeding conditions than the cassette number.

For example, the time T1 and T2 may be determined in accordance with the recording paper size detected by the paper size detecting sensors 251, 252, 253 and 254 and the paper cassette selection result input from the operation panel 40.

In addition, the driving motor M2 may be driven in accordance with combination of the cassette number and one or more other paper feeding conditions. In this case, more accurate control is possible.

Figure 14:
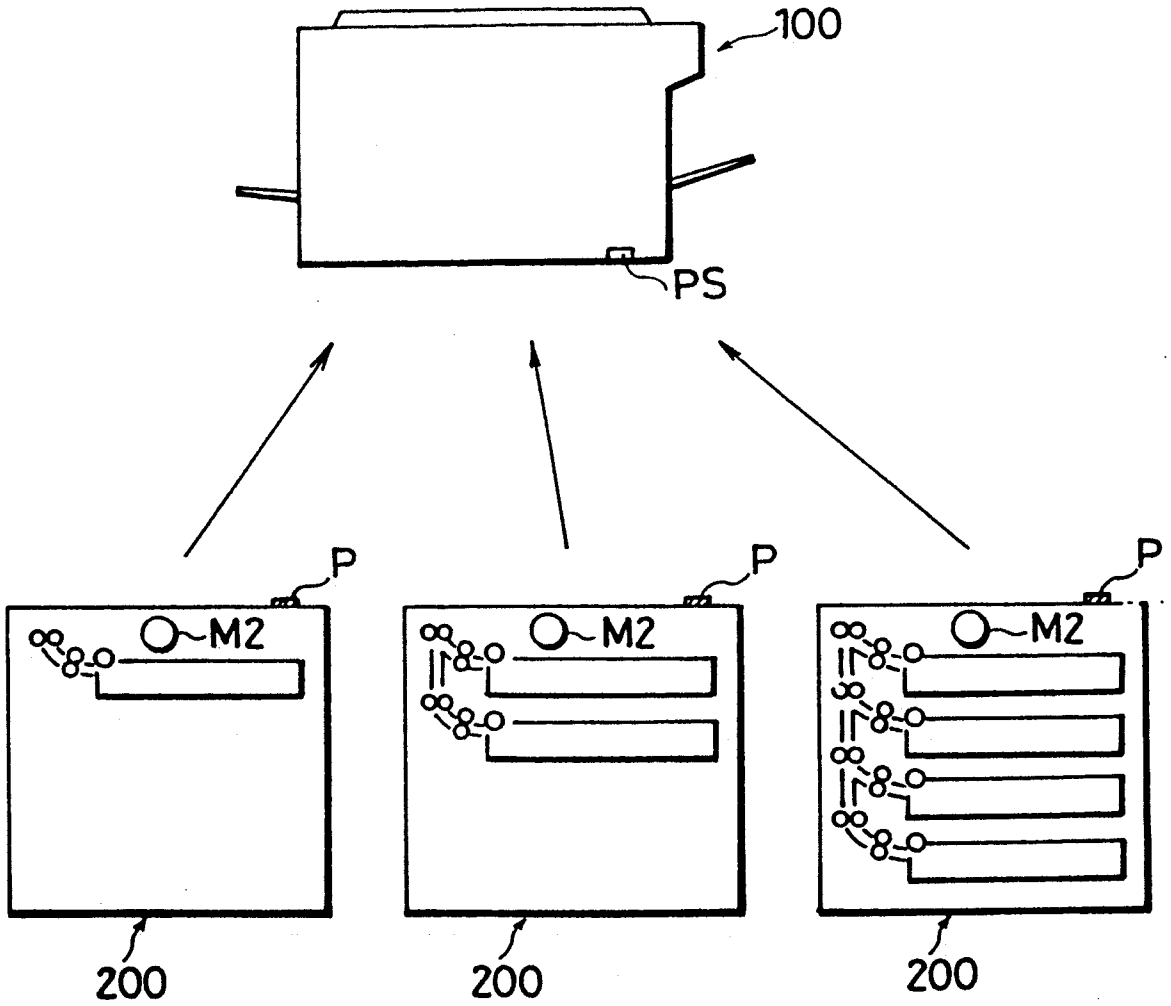
FIG. 14 is a cross sectional view showing an example wherein a pattern P and a photosensor PS for identifying the number of paper cassettes are provided respectively in the paper feeding cabinet and the main body.

In the above Embodiment 2 also, the cassette number is input from the operation panel 40. The cassette number may be detected by providing a pattern P (for example, bar code) at a specific position in the paper feeding cabinet 200 and a photosensor PS for detecting the pattern P at a position opposed to the pattern P in the main body, as shown in FIG. 14.

The cassette number is not limited to 4 in the above two embodiments.

In addition, the speed of the driving motor M2 is not limited to "H" and "L" and may be changed over between 3 or more speeds.

Further, the number of driving systems is not limited to 2 and the present invention may of course be applied to a copier having 3 or more driving systems.

Further, the present invention is not limited to a copier and may be applied to another image forming apparatus having an image forming section and a paper feeding cabinet like a facsimile machine.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

first transport means for transporting a recording paper;

second transport means provided upstream of said first transport means in a transport direction of the recording paper;

control means for generating a first stop signal and a second stop signal at different timings after said recording paper is held by both said first transport means and said second transport means so that the recording paper is stopped while being held by both said first and second transport means; and driving means for driving said first and second transport means and for stopping said first transport means in response to the first stop signal and stopping said second transport means in response to the second stop signal.

2. An image forming apparatus as claimed in claim 1, wherein said driving means includes a first driving system for driving said first transport means and a second driving system for driving said second transport means and wherein said first and second transport means are respectively stopped after a first time and a second time have passed since the first and second stop signals are generated, the first and second times being different from each other.

3. An image forming apparatus as claimed in claim 2, wherein one of the first and second stop signals is generated after the other stop signal corresponding to the longer one of the first and second times is generated.

4. An image forming apparatus as claimed in claim 3, wherein said driving means further includes a first motor for driving said first transport means and a second motor for driving said second transport means independently of the first motor.

5. An image forming apparatus as claimed in claim 4, wherein said driving means further includes clutch means for interrupting transmission of driving force of the first motor to said first transport means in response to the first stop signal and wherein the second motor is stopped in response to the second stop signal.

6. An image forming apparatus as claimed in claim 1, wherein said control means generates a first driving signal and a second driving signal at different timings so that the recording paper which has been stopped being held by both said first and second transport means is transported again and wherein said driving means starts driving said first transport means in response to the first driving signal and starts driving said second transport means in response to the second driving signal.

7. An image forming apparatus as claimed in claim 6, wherein said control means generates the first stop signal after generating the second stop signal and generates the first driving signal after generating the second driving signal.

8. An image forming apparatus as claimed in claim 1, wherein said control means includes changing means for changing time difference between the timings at which the first and second stop signals are generated.

9. An image forming apparatus, comprising:

first transport means for transporting a recording paper;

second transport means provided upstream of said first transport means in a transport direction of the recording paper;

control mean for generating a first stop signal and a second stop signal after said recording paper is held by both said first transport means and said second transport means so that the recording paper is stopped while being held by both said first and second transport means and for generating a first driving signal and a second driving signal so that the recording paper which has been stopped while being held by both said first and second transport means is transported again; and driving means for stopping and driving said first transport means respectively in response to the first stop signal and the first driving signal and for stopping and driving said second transport means respectively in response to the second stop signal and the second driving signal, wherein said control means generates the first driving signal after generating the second driving signal.

10. An image forming apparatus as claimed in claim 9, wherein said driving means includes a first driving system which starts driving in response to the first driving signal and a second driving system which starts driving in response to the second driving signal, wherein the moment of inertia of the second driving system is greater than that of the first driving system.

11. An image forming apparatus as claimed in claim 10, wherein said control means generates the first stop signal after generating the second stop signal.

12. An image forming apparatus as claimed in claim 11, wherein said driving means includes a first motor for driving said first transport means and a second motor for driving said second transport means independently of the first motor.

13. An image forming apparatus as claimed in claim 12, wherein said driving means includes clutch means for interrupting transmission of driving force of the first motor to said first transport means in response to the first stop signal and for transmitting the driving force of the first motor to said first transport means in response to the first driving signal and wherein the second motor is stopped in response to the second stop signal and is driven in response to the second driving signal.

14. An image forming apparatus, comprising:

a first pair of rollers for transporting a plurality of recording papers sequentially;

a second pair of rollers provided upstream of said first pair of rollers in a transport direction of the recording paper;

control means for generating a first stop signal and a second stop signal at different timings after a recording paper is held by both said first pair of rollers and said second pair of rollers so that said first pair of rollers and said second pair of rollers are stopped respectively while holding the recording paper; and driving means for driving said first and second pairs of rollers, stopping said first pair of rollers in response to the first stop signal and stopping said second pair of rollers in response to the second stop signal.

15. An image forming apparatus as claimed in claim 14, wherein said driving means includes a first driving system for driving said first pair of rollers and a second driving system for driving said second pair of rollers, wherein said first and second pairs of rollers are respectively stopped after a first time and a second time have passed since the first and second stop signals are generated, the first and second times being different from each other.

16. An image forming apparatus as claimed in claim 14, wherein the first stop signal is generated after the second stop signal is generated.

17. An image forming apparatus as claimed in claim 14, wherein said driving means further includes a first motor for driving said first pair of rollers and a second motor for driving said second pair of rollers independently of the first motor.

18. An image forming apparatus as claimed in claim 17, wherein said driving means further includes clutch means for interrupting transmission of driving force of the first motor to said first pair of rollers in response to the first stop signal, wherein the second motor is stopped in response to the second stop signal and wherein said control means generates the first stop signal after generating the second stop signal.

19. An image forming apparatus as claimed in claim 14, wherein said control means generates a second driving signal when the first and second pairs of rollers are at a stop holding the recording paper and generates a first driving signal after generating the second driving signal and wherein said driving means starts driving said second pair of rollers in response to the second driving signal and starts driving said first pair of rollers in response to the first driving signal.

20. An image forming apparatus as claimed in claim 14, wherein said control means includes changing means for changing time difference between the timings at which the first and second stop signals are generated.

21. An image forming apparatus, comprising:

an image forming unit including image forming means for forming an image on a recording paper and first transport means for transporting the recording paper to the image forming means; and a paper feeding unit including second transport means for feeding the recording papers to said image forming unit one by one, wherein said image forming unit further includes control means for generating a first stop signal and a second stop signal at different timings after a recording paper is held by both said first transport means and said second transport means so that the recording paper is stopped while being held by both said first and second transport means, and first driving means for driving the first transport means and stopping the first transport means in response to the first stop signal, and wherein said paper feeding unit further includes second driving means for driving the second transport means and stopping the second transport means in response to the second stop signal.

22. An image forming apparatus as claimed in claim 21, wherein the first driving means has a first motor for driving the first transport means and clutch means for interrupting transmission of driving force of the first motor to the first transport means in response to the first stop signal, wherein the second driving means has a second motor for driving the second transport means independently of the first motor, the second motor being stopped in response to the second stop signal, and wherein the control means generates the first stop signal after generating the second stop signal.

23. An image forming apparatus as claimed in claim 21, wherein the control means has changing means for changing time difference between timings at which the first and second stop signals are generated.

24. An image forming apparatus as claimed in claim 21, wherein said paper feeding unit is capable of accommodating a plurality of recording papers to be fed to said image forming unit and includes detecting means for detecting the size of the recording paper accommodated therein and wherein the control means changes the time difference between the timings for generating the first and second stop signals on the basis of the size of the recording paper detected by the detecting means.

25. An image forming system, comprising:

an image forming unit including:

image forming means for forming an image on a recording paper, first transport means for transporting the recording paper to the image forming means, control means for generating a first stop signal and a second stop signal at different timings, and first driving means for driving the transport means and stopping the first transport means in response to the first stop signal; and a plurality of paper feeding units, each paper feeding unit being connectable with said image forming unit and including:

second transport means for feeding the recording papers to the first transport means one by one, and second driving means for driving the second transport means and stopping the second transport means in response to the second stop signal;

wherein the control means has changing means for changing time difference between the timings at which the first and second stop signals are generated.

26. An image forming system as claimed in claim 25, wherein said plurality of paper feeding units have different constructions from each other and wherein the changing means changes the time difference between the timings for generating the first and second stop signals in accordance with the construction of the paper feeding unit connected with said image forming unit.

27. An image forming system as claimed in claim 25, wherein each paper feeding unit includes at least one paper accommodating means for accommodating a plurality of recording papers to be fed to said image forming unit and wherein the changing means changes the time difference between the timings for generating the first and second stop signals in accordance with the number of paper accommodating means of said paper feeding unit connected with said image forming unit.

28. An image forming apparatus connectable with a paper feeding apparatus which accommodates a plurality of recording papers and feeds the plurality of recording papers to said image forming apparatus one by one, said image forming apparatus comprising:

image forming means for forming an image on a recording paper fed from said paper feeding apparatus;

first transport means for receiving a recording paper from second transport means provided in said paper feeding apparatus and for transporting the received recording paper to said image forming means;

control means for generating a first stop signal for stopping said first transport means and a second stop signal for stopping said second transport means at different timings; and changing means for changing time difference between the timings at which the first and second stop signals are generated.

29. An image forming apparatus as claimed in claim 28, further comprising a first motor for driving said first transport means and clutch means for interrupting transmission of driving force of the first motor to said first transport means in response to the first stop signal, wherein said control means generates the first stop signal after generating the second stop signal.

30. An image forming apparatus connectable with a paper feeding apparatus which accommodates a plurality of recording papers and feeds the plurality of recording papers to said image forming apparatus one by one, said image forming apparatus comprising:

image forming means for forming an image on a recording paper fed from said paper feeding apparatus;

first transport means for receiving a recording paper from second transport means provided in said paper feeding apparatus and for transporting the received recording paper to said image forming means; and control means for generating a first stop signal for stopping said first transport means and a second stop signal for stopping said second transport means at different timings after said recording paper is held by both said first transport means and said second transport means so that the recording paper is stopped while being held by both said first and second transport means.

31. An image forming apparatus as claimed in claim 30, wherein said control means generates the first stop signal after generating the second stop signal.

32. An image forming apparatus as claimed in claim 31, further comprising a first motor for driving said first transport means and clutch means for interrupting transmission of driving force of the first motor to said first transport means in response to the first stop signal.

* * * * *